US011810502B2

(12) United States Patent
Lee et al.

(10) Patent No.: US 11,810,502 B2
(45) Date of Patent: Nov. 7, 2023

(54) ELECTROLUMINESCENT DISPLAY APPARATUS

(71) Applicant: LG Display Co., Ltd., Seoul (KR)

(72) Inventors: Chang Woo Lee, Paju-si (KR); Jin Hyun Jung, Paju-si (KR); Sun Yoon Kim, Paju-si (KR); Hyun Wook Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/953,732

(22) Filed: Sep. 27, 2022

(65) Prior Publication Data

US 2023/0095234 A1 Mar. 30, 2023

(30) Foreign Application Priority Data

Sep. 28, 2021 (KR) ..... 10-2021-0127998

(51) Int. Cl.
*G09G 3/32* (2016.01)

(52) U.S. Cl.
CPC ..... *G09G 3/32* (2013.01); *G09G 2310/08* (2013.01); *G09G 2330/10* (2013.01)

(58) Field of Classification Search
CPC .. G09G 2310/08; G09G 2330/10; G09G 3/32; G09G 2310/0297; G09G 3/006
See application file for complete search history.

(56) References Cited

U.S. PATENT DOCUMENTS 10,565,909 B2 * 2/2020 Xu ..... G09G 3/3225
2008/0055211 A1 * 3/2008 Ogawa ..... G09G 3/3225 345/77
2014/0329339 A1 * 11/2014 Chaji ..... G09G 3/006 438/10
2019/0304350 A1 10/2019 Siu et al.
2021/0337143 A1 * 10/2021 Lin ..... H04N 25/58

* cited by examiner

*Primary Examiner* — Muhammad N Edun
(74) *Attorney, Agent, or Firm* — Birch, Stewart, Kolasch & Birch, LLP

(57) ABSTRACT

An electroluminescent display apparatus including a pixel connected to a detection line; a panel driving circuit configured to off-drive a driving element included in the pixel in a detection interval; a reference voltage generating circuit configured to supply a detection reference voltage to the detection line prior to the detection interval, generate a first comparator reference voltage which is higher than the detection reference voltage in the detection interval, and generate a second comparator reference voltage which is lower than the detection reference voltage in the detection interval; a comparator configured to compare the first comparator reference voltage with a voltage of the detection line to generate a first comparison output at a first timing of the detection interval and comparing the second comparator reference voltage with the voltage of the detection line to generate a second comparison output at a second timing of the detection interval; and a logic circuit configured to determine an occurrence of a defect of the pixel based on the first comparison output and the second comparison output and to perform dark spot processing of the defective pixel.

20 Claims, 29 Drawing Sheets

FIG. 6

| DIVISION | DEFECT TYPE | COMPARATOR OUTPUT(VCO) | | OTHER |
|---|---|---|---|---|
| | | vs TH-HIGH | vs TH-LOW | |
| NORMAL | NO | 1 | 0 | |
| DT (Driving TFT) | GS Short | 1 | 1 | Underflow |
| | GD, DS Short | 0 | 0 | Overflow |
| ST2 (Sense TFT) | GS Short | 0 | 0 | Overflow |
| | GD, DS Short | 0 | 0 | Overflow |
| EL | AC Short | 1 | 1 | Underflow |
| Line | EVDD-SIO Short | 0 | 0 | Overflow |
| | EVSS-SIO Short | 1 | 1 | Underflow |
| | | VCO1 | VCO2 | |

FIG. 23

| | DEFECT TYPE | DRC OUTPUT | |
|---|---|---|---|
| | | A2 | A3 |
| NORMAL | | DO : High ('1')<br>DU : Low ('0') | DO : High ('1')<br>DU : Low ('0') |
| | Overflow | DO : High ('1')<br>DU : Low ('0') | DO : Low ('0')<br>DU : Low ('0') |
| | Underflow | DO : High ('1')<br>DU : Low ('0') | DO : High ('1')<br>DU : High ('1') |

FIG. 27

| | DEFECT TYPE | DRC OUTPUT | |
|---|---|---|---|
| | | B11 | B12 |
| NORMAL | | RO : High ('1') | RO : High ('1') |
| | Overflow | RO : High ('1') | RO : Low ('0') |

FIG. 28

| | DEFECT TYPE | DRC OUTPUT | |
|---|---|---|---|
| | | B21 | B22 |
| NORMAL | | RU : Low ('0') | RU : Low ('0') |
| | Underflow | RU : Low ('0') | RU : High ('1') |

ELECTROLUMINESCENT DISPLAY APPARATUS

CROSS-REFERENCE TO RELATED APPLICATIONS

This application claims the priority benefit of the Korean Patent Application No. 10-2021-0127998 filed on Sep. 28, 2021, and No. 10-2022-0114952 filed on Sep. 13, 2022, the entire contents of which are hereby incorporated by reference into the present application.

FIELD OF THE INVENTION

The present disclosure relates to an electroluminescent display apparatus and a display defect processing method thereof.

BACKGROUND

Electroluminescent display apparatuses are categorized into inorganic light emitting display apparatuses and electroluminescent display apparatuses based on a material of an emission layer. Each subpixel of electroluminescent display apparatuses includes a light emitting device self-emitting light and the amount of light emitted from the light emitting device is controlled with a data voltage based on a gray level of image data to adjust luminance.

When a subpixel is degraded as a driving time elapses, a hot spot defect can occur due to subpixel short circuit. A defective subpixel recognized as a hot spot decreases the visibility of a user to degrade display quality.

SUMMARY OF THE DISCLOSURE

To overcome the aforementioned problem of the related art, an embodiment of the present disclosure provides an electroluminescent display, which detects and compensates for a hot spot defect caused by a subpixel short circuit to increase the display quality.

In addition, the present disclosure provides an electroluminescent display apparatus, which minimizes a circuit unit for detecting and compensating for a hot spot defect caused by a subpixel short circuit, thereby reducing the manufacturing cost, and increasing the lifetime and reliability of products.

To achieve at least of these objects and other advantages and in accordance with the purpose of the disclosure, as embodied and broadly described herein, an electroluminescent display apparatus includes a pixel connected to a detection line, a panel driving circuit configured to off-drive a driving element included in the pixel in a detection interval, a reference voltage generating circuit configured to supply a detection reference voltage to the detection line prior to the detection interval, generate a first comparator reference voltage which is higher than the detection reference voltage in the detection interval, and generate a second comparator reference voltage which is lower than the detection reference voltage in the detection interval, a comparator configured to compare the first comparator reference voltage with a voltage of the detection line to generate a first comparison output at a first timing of the detection interval and comparing the second comparator reference voltage with the voltage of the detection line to generate a second comparison output at a second timing of the detection interval, and a logic circuit configured to determine the occurrence or not of a defect of the pixel based on the first comparison output and the second comparison output obtained in the detection interval.

In another aspect of the present disclosure, a display defect processing method of an electroluminescent display apparatus, including a pixel connected to a detection line, includes supplying the pixel with a scan signal having an on level and a detection data voltage having an off level to off-drive each driving element included in the pixel in a detection interval, sequentially generating a first reference voltage and a second reference voltage, supplying the first reference voltage to the detection line at a first timing of the detection interval, and supplying the second reference voltage to the detection line at a second timing of the detection interval, the second reference voltage being lower than the first reference voltage and the second timing being later than the first timing, comparing the first comparator reference voltage with a voltage of the detection line to generate a first comparison output at the first timing and comparing the second comparator reference voltage with the voltage of the detection line to generate a second comparison output at the second timing, and determining the occurrence or not of a defect of the pixel based on the first comparison output and the second comparison output.

In still another aspect of the present disclosure, an electroluminescent display apparatus comprises: a pixel; a panel driving circuit, connected to the pixel, and configured to supply the pixel with a scan signal having an on level and a detection data voltage having an off level in a detection interval; a comparator comparing comprising a first input terminal receiving a reference voltage and a second input terminal connected with the detection line; and a logic circuit determining the occurrence or not of a defect of the pixel based on a first comparison output and a second comparison output of the comparator at a first and second timings of the detection interval, respectively; wherein the reference voltage is set as, at a first timing, a first comparator reference voltage higher than a detection reference voltage, and at a second timing, a second comparator reference voltage lower than the detection reference voltage; and the detection reference voltage is the same as a voltage supplied to the detection line prior to the detection interval.

In yet another aspect of the present disclosure, an electroluminescent display apparatus including: a pixel connected to a detection line; a panel driving circuit configured to off-drive a driving element included in the pixel in a detection interval; a reference voltage generating circuit configured to supply a detection reference voltage to the detection line in an initialization interval preceding the detection interval; a dynamic logic circuit including a first output node and a second output node connected between a high level power and a second level power, the dynamic logic circuit being configured to generate a first logic output through a first output node and generate a second logic output through a second output node, and the first logic output and the second logic output being shifted based on a voltage of the detection line shifted from the detection reference voltage in the detection interval; and a logic circuit configured to determine occurrence or not of a defect in a pixel, based on the first logic output and the second logic output obtained in the detection interval.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIG. 6 is a diagram illustrating a comparator output of a defect processing circuit based on a defect type;

FIG. 23 is a diagram showing an output of a dynamic logic circuit of a defect processing circuit with respect to a defect type;

FIG. 27 is a diagram showing an output of a dynamic logic circuit performed in a first initialization interval and a first detection interval of FIG. 26; and FIG. 28 is a diagram showing an output of a dynamic logic circuit performed in a second initialization interval and a second detection interval of FIG. 26.

DETAILED DESCRIPTION OF THE EMBODIMENTS

Figure 1:
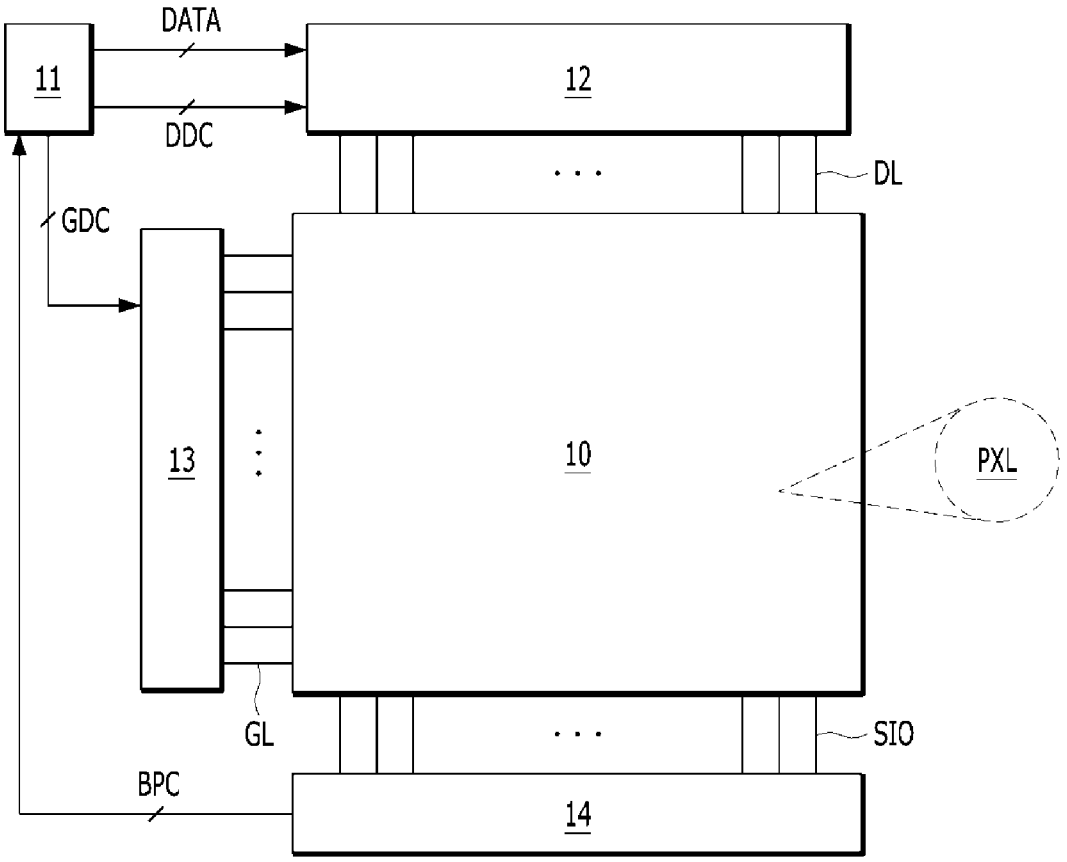
FIG. 1 is a block diagram illustrating an electroluminescent display apparatus according to an embodiment of the present disclosure.

Hereinafter, exemplary embodiments of the present disclosure will be described in detail with reference to the accompanying drawings. In the specification, in adding reference numerals for elements in each drawing, it should be noted that like reference numerals already used to denote like elements in other drawings are used for elements wherever possible. In the following description, when the detailed description of the relevant known function or configuration is determined to unnecessarily obscure the important point of the present disclosure, the detailed description will be omitted.

FIG. 1 is a block diagram illustrating an electroluminescent display apparatus according to an embodiment of the present disclosure. Referring to FIG. 1, the electroluminescent display apparatus includes a display panel 10, a timing controller 11, a data driver 12, a gate driver 13, and a defect processing circuit 14. The data driver 12 and the gate driver 13 can configure a panel driving circuit.

In addition, data lines DL extending in a column direction (or a vertical direction) intersect with gate lines GL extending in a row direction (or a horizontal direction), and pixels PXL are arranged as a matrix type in a plurality of intersection areas to configure a pixel array in the display panel 10. Each of the data lines DL is connected to pixels PXL adjacent thereto in the column direction in common, and each of the gate lines GL is connected to pixels PXL adjacent thereto in the row direction in common.

Each pixel PXL includes a plurality of subpixels to generate various color combinations. To simplify the pixel array, subpixels configuring the same pixel PXL can share a same detection line SIO.

As described above, when a subpixel is degraded as a driving time elapses, a hot spot defect can occur due to subpixel short circuit. In addition, the detection line SIO can be used to detect a defect of a corresponding pixel PXL. In the pixel array, detection lines SIO can be arranged in the column direction parallel to the data line DL, but are not limited thereto.

Further, the timing controller 11 receives a timing signal such as a vertical synchronization signal Vsync, a horizontal synchronization signal Hsync, a data enable signal DE, and a dot clock DCLK from a host system to generate timing control signals for controlling an operation timing of the panel driving circuit. The timing control signals can include a gate timing control signal GDC and a data timing control signal DDC.

The timing controller 11 can receive video data DATA from the host system and receive a defect compensation signal BPC from the defect processing circuit 14. The defect compensation signal BPC can be for partial or overall dark spot processing on a defective pixel PXL. When at least one of subpixels configuring one pixel PXL is defective, the one pixel PXL can be determined to be defective. In addition, the partial dark spot processing can substitute only one piece of video data DATA, which is to be applied to a defective subpixel, into block grayscale data, and the overall dark spot processing can substitute all video data DATA, which are to be applied to one pixel PXL having a defect, into block grayscale data. The timing controller 11 can also reflect the black grayscale data, based on the defect compensation signal BPC, in the video data DATA and supply the data driver 12 with the video data DATA in which the black grayscale data is reflected.

Further, the timing controller 11 can temporally divide display driving and detection driving based on the timing control signals DDC and GDC. The display driving is for displaying an input image on a screen based on the video data DATA in which the black grayscale data is reflected. Further, the detection driving is for detecting and partially or overall blackens a defective pixel PXL.

In addition, the display driving can be performed in a vertical active interval where the data enable signal is shifted from a logic high level to a logic low level in one frame, and sensing driving can be performed in a vertical blank interval except the vertical active interval in one frame. In the vertical blank interval, the data enable signal can continuously maintain a logic low level. Furthermore, the detection driving can be performed in a power on interval until before screen reproduction starts from after a system main power is applied, or can be performed in a power off interval until before the system main power is released from after the screen reproduction ends.

Further, the data driver 12 is connected to subpixels through the data lines DL. The data driver 12 can generate data voltages needed for display driving or detection driving of subpixels and supply the data voltages to the data lines DL, based on the data timing control signal DDC. A data voltage for the display driving can be a digital-to-analog conversion result of the video data DATA, and thus the data driver 12 can include a plurality of digital-to-analog converters. A data voltage for the detection driving can also be a detection data voltage having an on level or an off level.

Further, the data driver 12 includes a plurality of source driving integrated circuits (ICs). In particular, each source driving IC can include a shift register, a latch, the digital-to-analog converters, and an output buffer. Each source driving IC can further include a separate circuit for generating the detection data voltage.

In addition, as shown in FIG. 1, the gate driver 13 is connected to subpixels through the gate lines GL. In more detail, the gate driver 13 can generate scan signals based on the gate timing control signal GDC and respectively supply the scan signals to the gate lines GL based on a data voltage supply timing. A horizontal display line to which a data voltage is to be supplied can also be selected by the scan signal. Also, each of the scan signals can be generated in a pulse form which swings between a gate on level and a gate off level. A scan signal having a gate on level can be set to a voltage which is higher than a threshold voltage of a transistor included in a subpixel, and a scan signal having a gate off level can be set to a voltage which is lower than the threshold voltage of the transistor included in a subpixel. Further, the transistor included in a subpixel can be turned on in response to a scan signal having a gate on level and can be turned off in response to a scan signal having a gate off level.

Also, the gate driver 13 includes a gate shift register, a level shifter for converting an output signal of the gate shift register with a swing width of an on level and an off level, and a plurality of gate drive ICs each including an output buffer. Alternatively, the gate driver 13 can be directly provided on a substrate of the display panel 10 in a gate driver in panel (GIP) type. In the GIP type, the level shifter is mounted on a control printed circuit board (PCB), and the gate shifter register is provided in a bezel area which is a non-display area of the display panel 10. The gate shifter register can include a plurality of scan output stages connected to one another through cascade. The scan output stages can also be independently connected to the gate lines GL and can output the scan signals to the gate lines GL.

Further, as shown in FIG. 1, the defect processing circuit 14 is connected to the pixels PXL of the display panel 10 through detection lines SIO. The defect processing circuit 14 can supply a display reference voltage to subpixels through the detection lines SIO in display driving. The defect processing circuit 14 can also supply the display reference voltage and a detection reference voltage to the detection lines SIO in detection driving and can detect a voltage variation of each of the detection lines SIO caused by a short circuit defect of a subpixel by using a comparator or a dynamic logic circuit.

In addition, the defect processing circuit 14 can use the comparator illustrated in FIGS. 4 to 15, so as to detect a voltage variation of each detection line (SIO of FIG. 2) caused by a short circuit defect. To enhance the accuracy and reliability of detection, the comparator can be supplied with two comparator reference voltages having different voltage levels. In particular, the two comparator reference voltages can include a first comparator reference voltage and a second comparator reference voltage.

In the detection driving based on FIGS. 4 to 15, when a driving element of each subpixel is off-driven with a detection data voltage having an off level, a voltage of a detection line SIO connected to a normal pixel PXL is maintained as a detection reference voltage at a first timing and a second timing, and a voltage of a detection line SIO connected to a defective pixel PXL differs from the detection reference voltage at the first timing and the second timing due to a current inflow or current outflow caused by a short circuit defect.

In addition, the defect processing circuit 14 of FIGS. 4 to 15 can compare the first comparator reference voltage with a voltage of the detection line SIO at the first timing in the detection driving to generate a first comparison output, and compare the second comparator reference voltage with the voltage of the detection line SIO at the second timing in the detection driving to generate a second comparison output (where the second timing is later than the first timing). The defect processing circuit 14 can then determine the occurrence a defect of a pixel PXL based on the first comparison output and the second comparison output and output the defect compensation signal BPC based on a defective pixel PXL.

Further, the defect processing circuit 14 can use the dynamic logic circuit illustrated in FIGS. 16 to 28, to detect a voltage variation of each of the detection lines SIO caused by a short circuit defect of a subpixel. To enhance the accuracy and reliability of detection, the dynamic logic circuit can output a first logic output, which varies based on the voltage of the detection line SIO, through a first output node and output a second logic output, which varies based on the voltage of the detection line SIO, through a second output node. Because the dynamic logic circuit is implemented to have a circuit size which is less than that of the comparator, the dynamic logic circuit can be easily equipped in a source driving IC.

In the detection driving based on FIGS. 16 to 28, when the driving element of each subpixel is off-driven with the detection data voltage having an off level, a voltage of a detection line SIO connected to a normal pixel PXL is maintained as a detection reference voltage, and a voltage of a detection line SIO connected to a defective pixel PXL differs from the detection reference voltage due to current inflow or current outflow caused by a short circuit defect.

Further, the defect processing circuit 14 of FIGS. 16 to 28 can determine the occurrence of a defect in a pixel PXL based on the first logic output and/or the second logic output obtained through the dynamic logic circuit in detection driving and output the defect compensation signal BPC corresponding to a defective pixel PXL.

Figure 2:
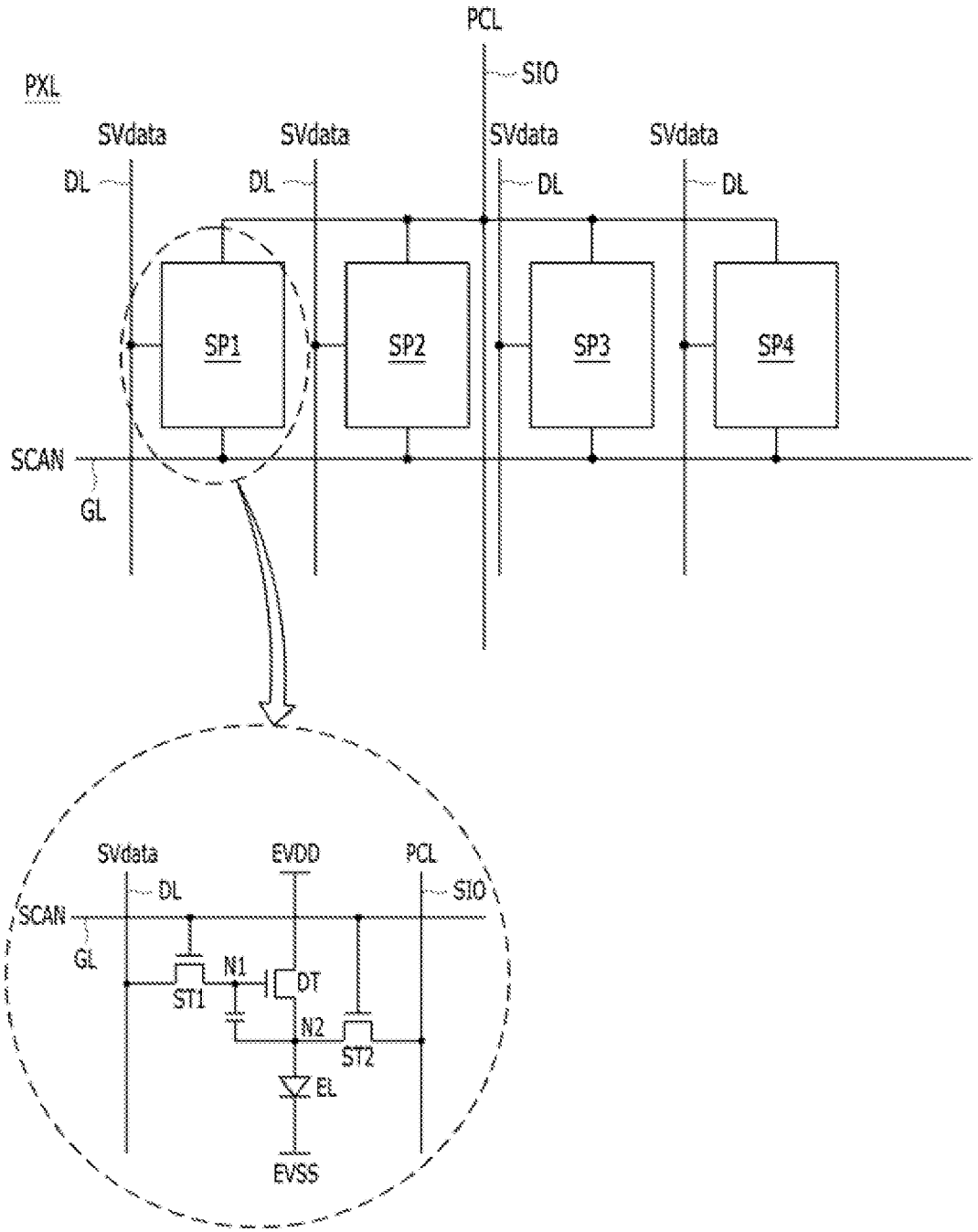
FIG. 2 is a diagram illustrating a connection configuration of a pixel according to an embodiment of the present disclosure.
Figure 3:
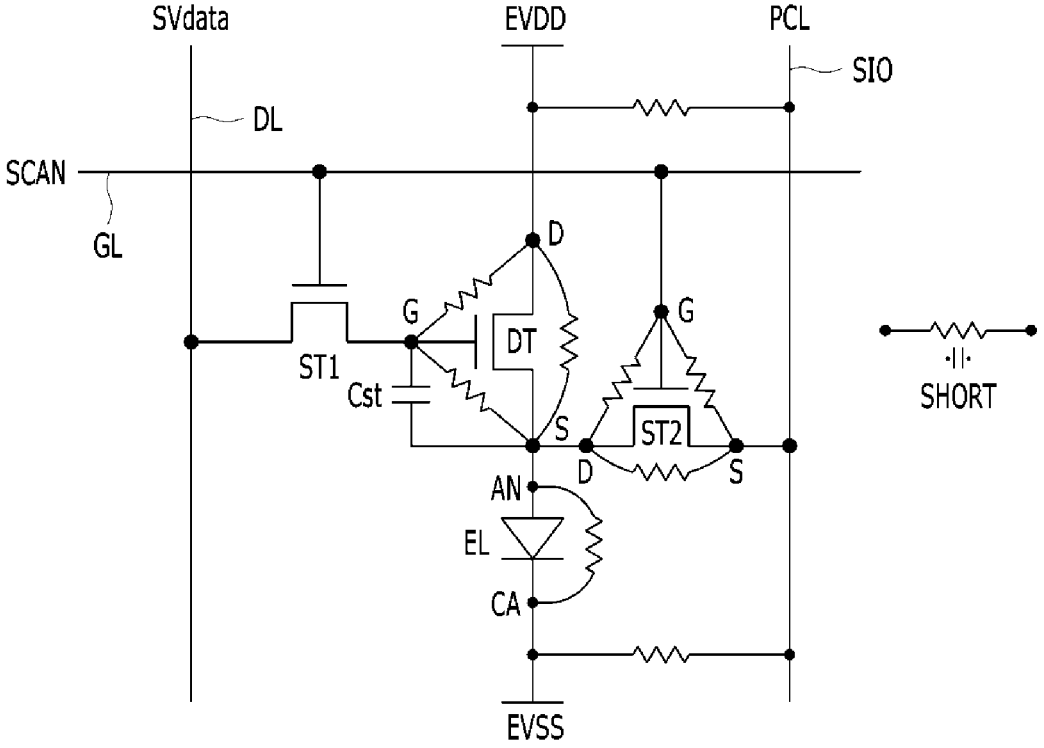
FIG. 3 is a diagram illustrating various defect types in a pixel according to an embodiment of the present disclosure.

Next, FIG. 2 is a diagram illustrating a connection configuration of a pixel according to an embodiment of the present disclosure, and FIG. 3 is a diagram illustrating various defect types in a pixel according to an embodiment of the present disclosure. FIG. 2 illustrates an example of the pixel PXL including four subpixels SP1 to SP4 which share a detection line SIO. The four subpixels SP1 to SP4 can include red (R), green (G), blue (B), and white (W) subpixels for configuring the same pixel. As shown, each of the four subpixels SP1 to SP4 can include, for example, a light emitting device EL, a driving element DT, switch elements ST1 and ST2, and a storage capacitor Cst, but is not limited thereto.

Further, the light emitting device EL can emit light with a display driving current supplied from the driving element DT. For example, the light emitting device EL can emit light only during the display driving and not emit light in the detection driving. In addition, the light emitting device EL can be implemented with an organic light emitting diode including an organic emission layer, or can be implemented with an inorganic light emitting diode including an inorganic emission layer. As shown, an anode electrode of the light emitting device EL is connected to a second node N2, and a cathode electrode thereof is connected to an input terminal for a low level source voltage EVSS.

In the display driving, the driving element DT can generate a display driving current based on a first gate-source voltage thereof (i.e., a difference voltage between a display data voltage and a display reference voltage) and supply the display driving current to the light emitting device EL. Further, in the detection driving, the driving element DT can be off-driven with a second gate-source voltage thereof (i.e., a difference voltage between a detection reference voltage PCL and a detection data voltage SVdata having an off level), and a current does not flow in the off-driven driving element DT. Furthermore, in the detection driving, the driving element DT can be on-driven with a third gate-source voltage thereof (i.e., a difference voltage between the detection reference voltage PCL and a detection data voltage SVdata having an on level). Also, a current can flow in the on-driven driving element DT. However, because the current is low, the light emitting device EL does not emit light. In addition, as shown, a gate electrode of the driving element DT is connected to a first node N1, a drain electrode thereof is connected to an input terminal for a high level source voltage EVDD, and a source electrode thereof is connected to the second node N2.

Further, the switch elements ST1 and ST2 can be turned on in the display driving and the detection driving, and thus connect the gate electrode of the driving element DT to the data line DL and connect the source electrode of the driving element DT to the detection line SIO. The switch elements ST1 and ST2 can also be turned on based on the same scan signal SCAN. Also, the switch elements (for example, first and second switch elements) ST1 and ST2 can continuously maintain a turn-on state in the detection driving.

In addition, the first switch element ST1 can be connected between the data line DL and the first node N1 and can be turned on based on the scan signal SCAN from the gate line GL. The first switch element ST1 can also be turned on in programming for the display driving, and be turned on in the detection driving. When the first switch element ST1 is turned on, the detection data voltage SVdata or the display data voltage are applied to the first node N1. A gate electrode of the first switch element ST1 is also connected to the gate line GL, a source electrode thereof is connected to the data line DL, and a drain electrode thereof is connected to the first node N1.

Further, the second switch element ST2 can be connected between the detection line SIO and the second node N2 and can be turned on based on the scan signal SCAN from the gate line GL. In programming for the display driving, the second switch element ST2 can be turned on and apply the display reference voltage, charged into the detection line SIO, to the second node N2. In the detection driving, the second switch element ST2 can be turned on and can apply the detection reference voltage PCL, charged into the detection line SIO, to the second node N2. A gate electrode of the second switch element ST2 is connected to the gate line GL, a drain electrode thereof is connected to the second node N2, and a source electrode thereof is connected to the detection line SIO.

In addition, as shown, the storage capacitor Cst is connected between the first node N1 and the second node N2 and can store the gate-source voltage of the driving element DT. Such a subpixel can include at least one of various defect types illustrated in FIG. 3. In particular, the defect types include a subpixel short circuit defect associated with the driving element DT, a subpixel short circuit defect associated with the second switch element ST2, a subpixel short circuit defect associated with the light emitting device EL, and a subpixel short circuit defect associated with the detection line SIO. When a subpixel short circuit defect occurs, a voltage of the detection line SIO may not maintain the detection reference voltage PCL and can be shifted from the detection reference voltage PCL in the detection driving.

Subpixel short circuit associated with the driving element DT can include gate-source short circuit (GS short circuit) of the driving element DT, gate-drain short circuit (GD short circuit) of the driving element DT, and drain-source short circuit (DS short circuit) of the driving element DT. Subpixel short circuit associated with the second switch element ST2 can include gate-source short circuit (GS short circuit) of the second switch element ST2, gate-drain short circuit (GD short circuit) of the second switch element ST2, and drain-source short circuit (DS short circuit) of the second switch element ST2. Subpixel short circuit associated with the light emitting device EL can denote short circuit between the anode electrode and the cathode electrode of the light emitting device EL. Subpixel short circuit associated with the detection line SIO can include short circuit between the detection line SIO and the high level source voltage EVDD and short circuit between the detection line SIO and the low level source voltage EVSS.

Figure 4:
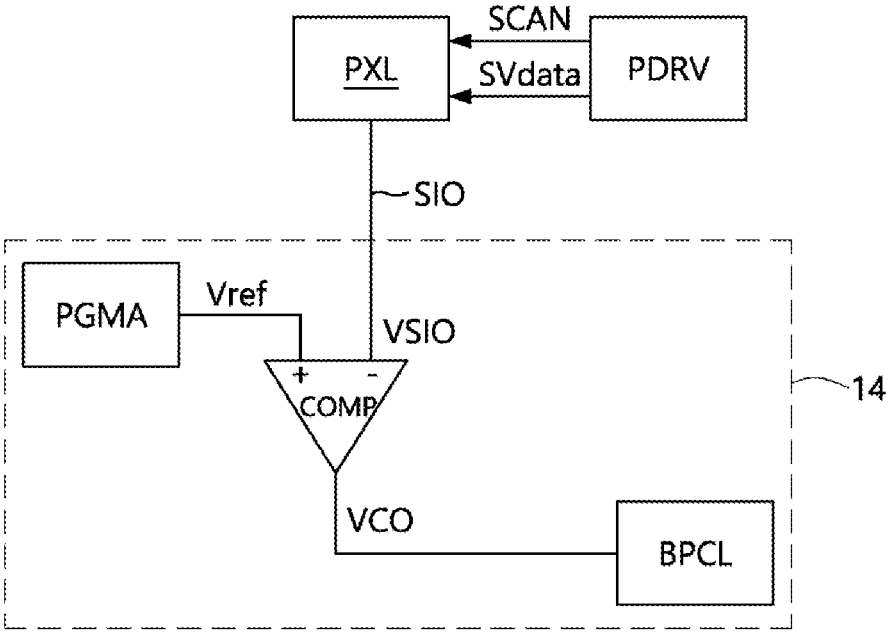
FIG. 4 is a diagram illustrating a connection configuration of a pixel and a defect processing circuit according to an embodiment of the present disclosure.
Figure 5:
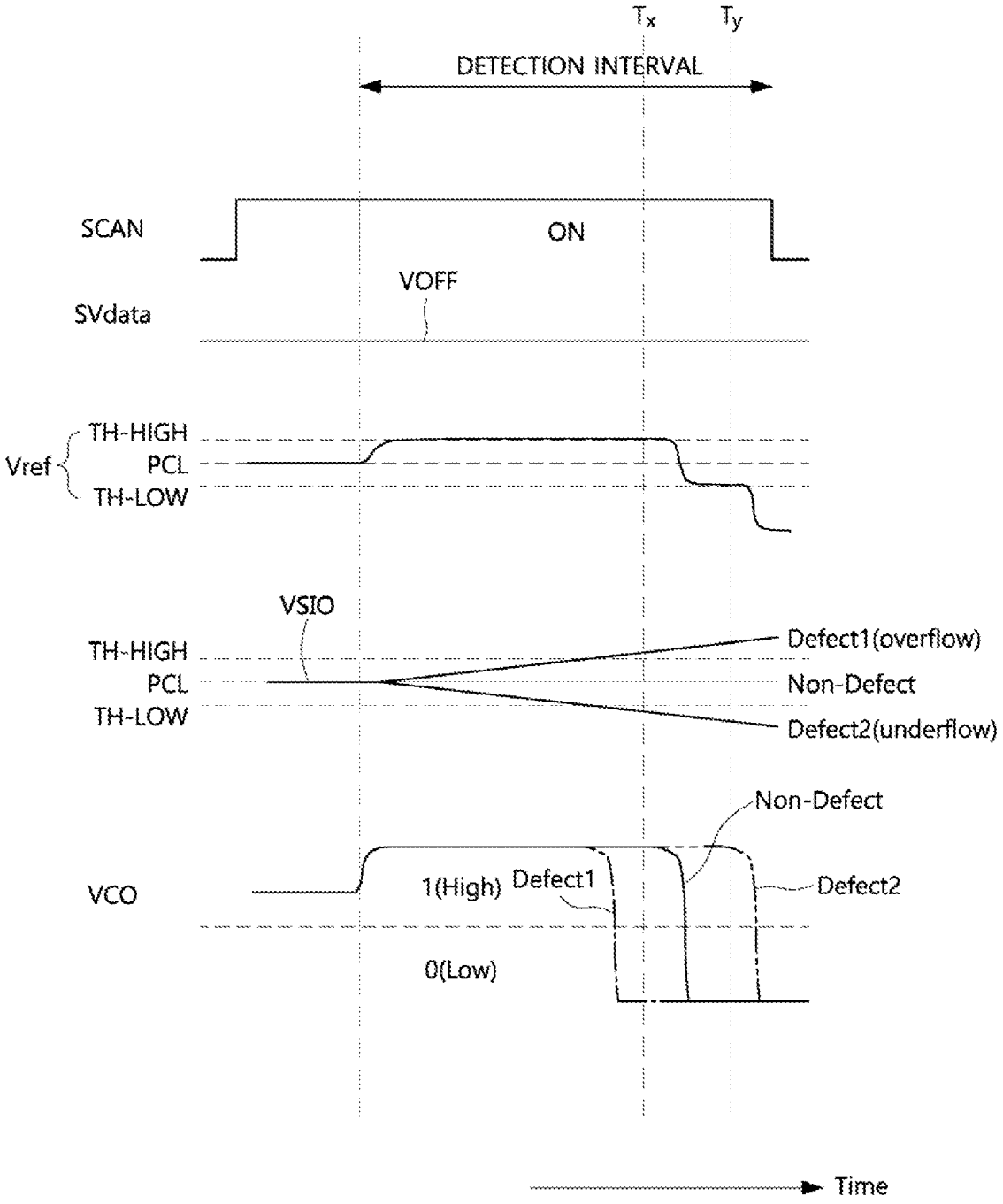
FIG. 5 is a diagram illustrating a driving waveform of a pixel and a defect processing circuit according to an embodiment of the present disclosure.

Next, FIG. 4 is a diagram illustrating a connection configuration of a pixel and a defect processing circuit, FIG. 5 is a diagram illustrating a driving waveform of a pixel and a defect processing circuit, and FIG. 6 is a diagram illustrating a comparator output based on a defect type according to an embodiment of the present disclosure.

Referring to FIG. 4, the electroluminescent display apparatus includes a panel driving circuit PDRV and a defect processing circuit 14, for detecting and compensating for subpixel short circuit occurring in a pixel PXL. As shown in FIG. 4, the defect processing circuit 14 can include a simple configuration of a reference voltage generating circuit PGMA, a comparator COMP, and a logic circuit BPCL, and thus a size of a circuit unit and the manufacturing cost can be reduced. In addition, the defect processing circuit 14 can partially or overall blacken a pixel PXL where the subpixel short circuit occurs, and thus a hot spot defect can be removed and the lifetime and reliability of products can be increased.

Referring to FIGS. 4 to 6, the panel driving circuit PDRV can supply the pixel PXL with a scan signal SCAN having an on level and a detection data voltage SVdata having an off level VOFF in a detection interval to off-drive each driving element included in the pixel PXL. In addition, a detection reference voltage PCL can be charged into the detection line SIO connected to the pixel PXL.

When a subpixel short circuit defect occurs in the pixel PXL, a voltage VSIO of the detection line SIO is not maintained as the detection reference voltage PCL in the detection interval and can increase or decrease from the detection reference voltage PCL. The reference voltage generating circuit PGMA can generate a reference voltage Vref having three voltage levels, which is applied to the comparator COMP. The three voltage levels can include the detection reference voltage PCL which is to be supplied to the detection line SIO through the comparator COMP prior to the detection interval, a first comparator reference voltage TH-HIGH which is higher than the detection reference voltage PCL, and a second comparator reference voltage TH-LOW which is lower than the detection reference voltage PCL. The detection reference voltage PCL can be a voltage for initializing the voltage VSIO of the detection line SIO and the comparator COMP. The first comparator reference voltage TH-HIGH can be a comparator reference voltage for detecting a defect 1 (an overflow type) where the voltage VSIO of the detection line SIO increases from the detection reference voltage PCL. Also, the second comparator reference voltage TH-LOW can be a comparator reference voltage for detecting a defect 2 (an underflow type) where the voltage VSIO of the detection line SIO decreases from the detection reference voltage PCL.

In addition, the defect 1 of the overflow type can occur due to the GD and DS short circuits of the driving element DT, the GS, GD, and DS short circuits of the second switch element ST2, and short circuit between the detection line SIO and a high level source voltage EVDD. Also, the defect 2 of the underflow type can occur due to the GS short circuit of the driving element DT, short circuit (AC short circuit) between an anode electrode and a cathode electrode of the light emitting device EL, and short circuit between the detection line SIO and a low level source voltage EVSS.

Further, the comparator COMP can compare the first comparator reference voltage TH-HIGH with the voltage VSIO of the detection line SIO to generate a first comparison output VCO1 at a first timing Tx of the detection interval and can compare the second comparator reference voltage TH-LOW with the voltage VSIO of the detection line SIO to generate a second comparison output VCO2 at a second timing Ty succeeding the first timing Tx of the detection interval. The first comparison output VCO1 and the second comparison output VCO2 can each be one of '1' representing a high voltage and '0' representing a low voltage.

At the first timing Tx, when the voltage VSIO of the detection line SIO is lower than the first comparator reference voltage TH-HIGH, the comparator COMP can output a high voltage 1 as the first comparison output VCO1, and when the voltage VSIO of the detection line SIO is higher than or equal to the first comparator reference voltage TH-HIGH, the comparator COMP can output a low voltage 0 as the first comparison output VCO1. This is because the voltage VSIO of the detection line SIO is input to a second input terminal (−) of the comparator COMP.

At the second timing Ty, when the voltage VSIO of the detection line SIO is higher than the second comparator reference voltage TH-LOW, the comparator COMP can output the low voltage 0 as the second comparison output VCO2, and when the voltage VSIO of the detection line SIO is lower than or equal to the second comparator reference voltage TH-LOW, the comparator COMP can output the high voltage 1 as the second comparison output VCO2.

The logic circuit BPCL can determine the occurrence (or not) of a defect of the pixel PXL based on the first comparison output VCO1 and the second comparison output VCO2. In more detail, the logic circuit BPCL can determine the occurrence of a defect of the pixel PXL based on a logic combination of the first comparison output VCO1 and the second comparison output VCO2. Only when the logic combination of the first comparison output VCO1 and the second comparison output VCO2 is (1,0), the logic circuit BPCL can determine that the pixel PXL is in a normal state, and otherwise, can determine that the pixel PXL is in an abnormal state. For example, when the logic combination of the first comparison output VCO1 and the second comparison output VCO2 is (1,1), the logic circuit BPCL can determine that the pixel PXL includes the defect 2 of the underflow type, and when the logic combination of the first comparison output VCO1 and the second comparison output VCO2 is (0,0), the logic circuit BPCL can determine that the pixel PXL includes the defect 1 of the overflow type. In addition, the logic circuit BPCL can output a defect compensation signal BPC (see FIG. 1) with respect to a defective pixel PXL, and thus, can allow the defective pixel PXL to be blackened.

Figure 7:
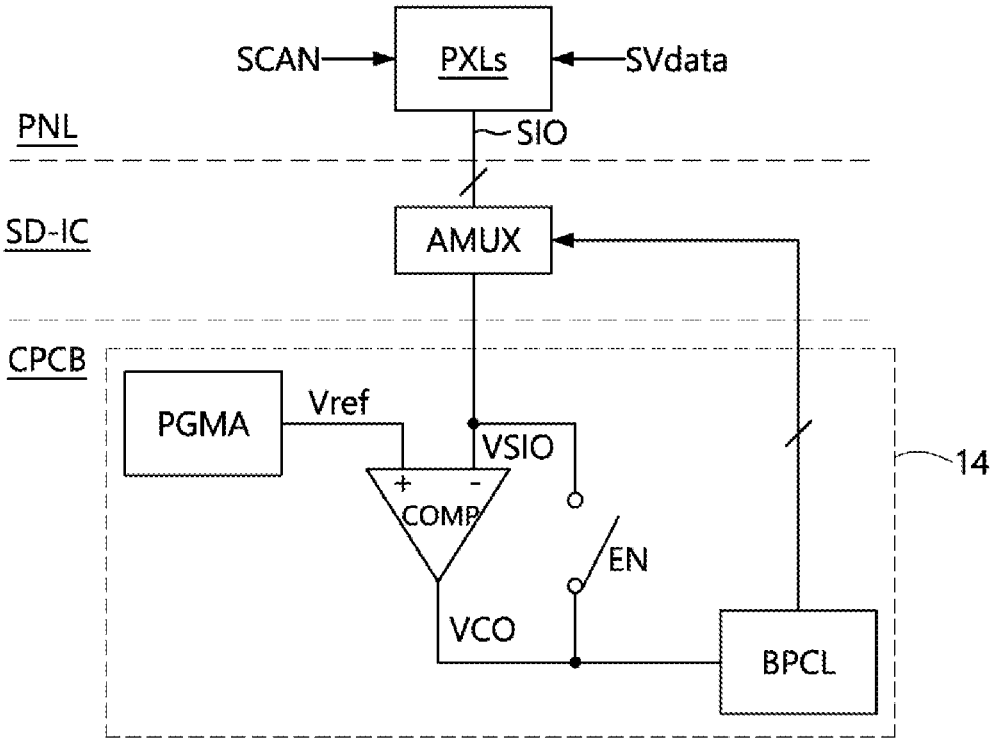
FIG. 7 is a diagram schematically illustrating a first embodiment where a comparator of a defect processing circuit is mounted on a control printed circuit board.

Next, FIG. 7 is a diagram schematically illustrating a first embodiment where a comparator is mounted on a control PCB. Referring to FIG. 7, a comparator COMP is mounted on a control PCB CPCB along with a logic BPCL and a reference voltage generating circuit PGMA. In this instance, because the number of comparators COMP is less than the number of detection lines SIO, a size of a circuit unit and the manufacturing cost can be considerably reduced. In addition, one comparator COMP can be connected to a multiplexer array AMUX in each source driving IC SD-IC. A plurality of multiplexer switches included in the multiplexer array AMUX can selectively connect the comparator COMP to a plurality of detection lines SIO. A turn-on/off operations of each of the multiplexer switches can also be controlled by the logic circuit BPCL. Further, the multiplexer switches can be selectively turned on in a detection interval, and in an initialization interval preceding the detection interval, all of the multiplexer switches can be turned on.

In addition, as shown in FIG. 7, the comparator COMP includes a first input terminal (+) through which a first comparator reference voltage TH-HIGH and a second comparator reference voltage TH-LOW are input, a second input terminal (−) through which a voltage VSIO of the detection line SIO is input, and an output terminal where a comparator output VCO (i.e., a first comparison output VCO1 and a second comparison output VCO2) is generated.

An enable switch EN is further connected between the second input terminal (−) and the output terminal of the comparator COMP. The enable switch EN can be turned off in the detection interval, and in the initialization interval preceding the detection interval, the enable switch EN can be turned on. In the initialization interval, when the enable switch EN and the multiplexer switches are turned on, the comparator COMP and the voltage VSIO of each of the detection lines SIO can be initialized to a detection reference voltage PCL from the reference voltage generating circuit PGMA.

Figure 8:
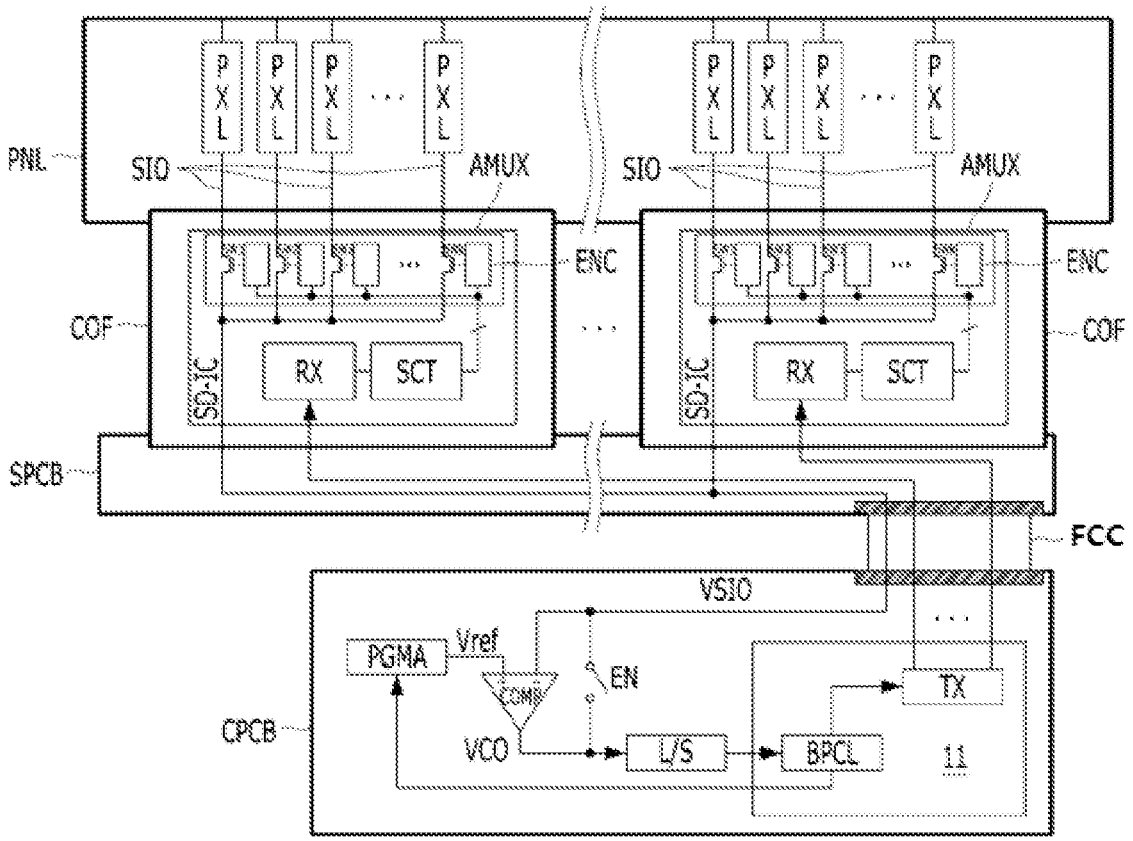
FIG. 8 is a diagram illustrating in detail a connection configuration according to the first embodiment of FIG. 7.
Figure 9:
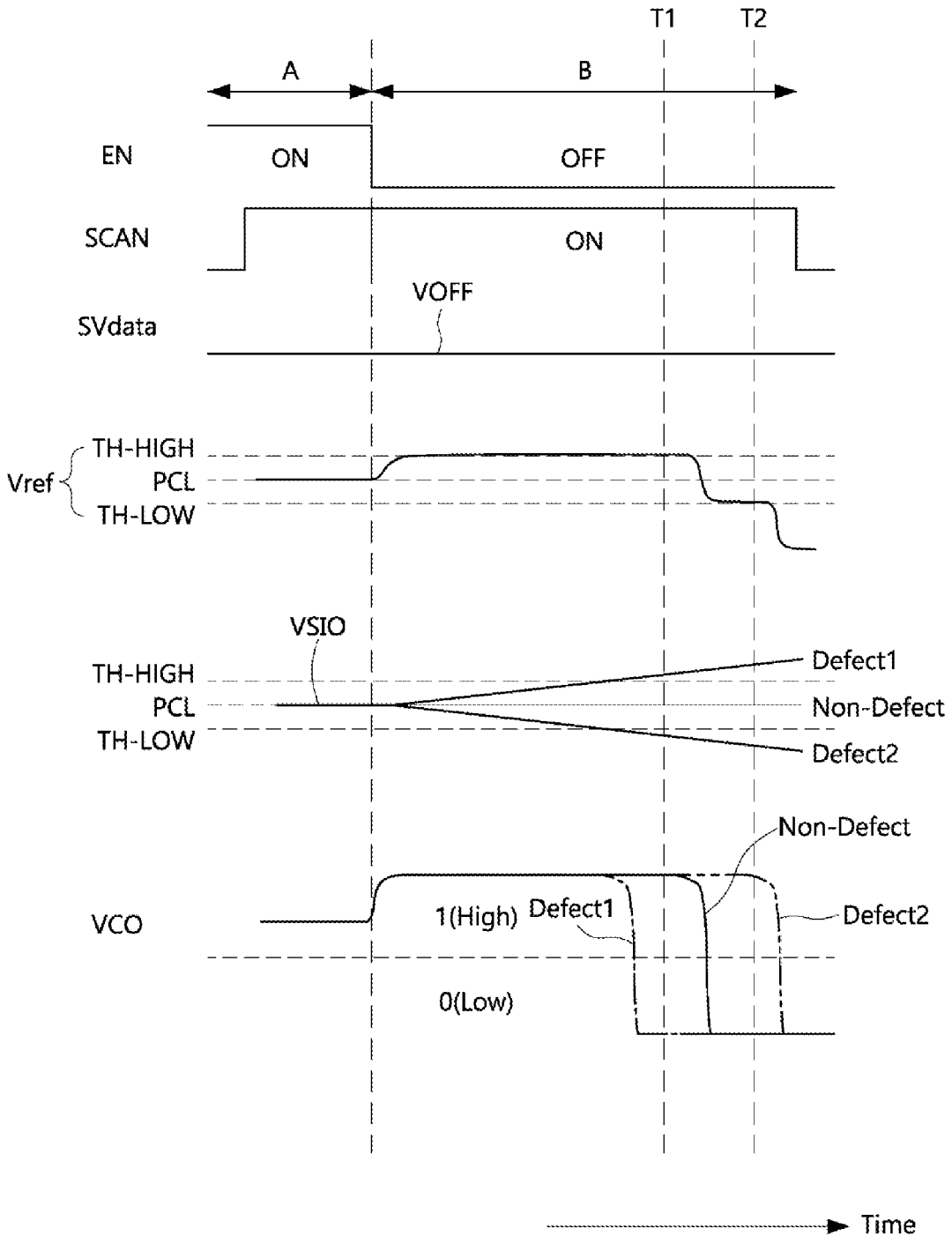
FIG. 9 is a diagram illustrating in detail a driving waveform of a connection configuration according to the first embodiment of FIG. 7.

Next, FIG. 8 is a diagram illustrating in detail a connection configuration according to the first embodiment of FIG. 7, and FIG. 9 is a diagram illustrating in detail a driving waveform of a connection configuration according to the first embodiment of FIG. 7. Referring to FIGS. 8 and 9, a display panel PNL and a source PCB (SPCB) can be electrically connected to each other through a conductive film COF, and a source driving IC (SD-IC) can be integrated on the conductive film COF. In addition to a data driver 12 (see FIG. 1) and a multiplexer array AMUX, a switch controller SCT and a receiver RX can be further mounted on the source driving IC SD-IC.

In addition, the SPCB and a control PCB (CPCB) can be electrically connected to each other through a flexible circuit cable (FCC), but are not limited thereto. The logic circuit BPCL can be provided as one body with a timing controller 11 (see FIG. 1) and can be mounted on the CPCB. The timing controller 11 (see FIG. 1) can further include a transferor TX for transferring a switch control signal generated by the logic circuit BPCL. The logic circuit BPCL can differently generate the switch control signal for each SD-IC, and can differently generate the switch control signal for each of multiplexer switches SW1 to SWk.

Further, the transferor TX and the receiver RX can be connected to each other through an internal interface circuit. Also, the switch control signal generated by the logic circuit BPCL can be added to a data transfer packet and transferred to the receiver RX by the transferor TX. The switch controller SCT can also convert the switch control signal, added to the data transfer packet, into a parallel digital signal and transfer the parallel digital signal to the multiplexer array AMUX.

In addition, the multiplexer array AMUX includes the plurality of multiplexer switches SW1 to SWk and a plurality of encoders ENC connected to gate electrodes of the multiplexer switches SW1 to SWk. The encoders ENC is also connected to the switch controller SCT and can receive the switch control signal from the switch controller SCT to control a turn-on/off operation of each of the multiplexer switches SW1 to SWk. Further, the switch control signal can be implemented as a multi-bit digital signal. For example, in the SD-IC including 240 detection channels, the switch control signal can be implemented as an 8-bit digital signal.

In addition, the comparator COMP mounted on the CPCB can be connected to a corresponding detection line SIO through a turned-on multiplexer switch. Also, the comparator COMP can be connected to a reference voltage generating circuit PGMA. Based on control by the logic circuit BPCL, the reference voltage generating circuit PGMA can generate a detection reference voltage PCL, which is to be charged into detection lines SIO, and first and second comparator reference voltages TH-HIGH and TH-LOW for a comparison operation of the comparator COMP. A level shifter L/S can be further connected between an output terminal of the comparator COMP and the logic circuit BPCL. Further, the level shifter L/S can reduce a voltage swing width of a comparator output VCO based on a transistor to transistor level (TTL), so that the comparator output VCO is processed by the logic circuit BPCL.

Also, an enable switch EN connected between a second input terminal (−) and an output terminal of the comparator COMP can be turned on in an initialization interval A, and thus the voltage VSIO of each of the detection lines SIO and the comparator output VCO can be initialized to the detection reference voltage PCL.

In a detection interval B succeeding an initialization interval A, a driving element of a pixel PXL connected to each of the detection lines SIO can be off-driven in response to a scan signal SCAN having an on level and a detection data voltage SVdata having an off level VOFF. In the detection interval B, a voltage VSIO of a detection line SIO connected to a normal pixel PXL can be maintained as the detection reference voltage PCL, and a voltage VSIO of a detection line SIO connected to a defective pixel PXL can increase or decrease from the detection reference voltage PCL. In the detection interval B, the comparator COMP can sequentially compare a voltage VSIO of a corresponding detection line SIO with two reference voltages Vref (i.e., a first comparator reference voltage TH-HIGH and a second comparator reference voltage TH-LOW) to generate a comparator output VCO. The comparator COMP can compare a voltage VSIO of a corresponding detection line SIO with the first comparator reference voltage TH-HIGH to generate a first comparison output VCO1 at a first timing T1 of the detection interval B, and then, can compare a voltage VSIO of a corresponding detection line SIO with the second comparator reference voltage TH-LOW to generate a second comparison output VCO2 at a second timing T2 of the detection interval B. As in FIG. 6 described above, a logic combination of the first comparison output VCO1 and the second comparison output VCO2 included in the comparator output VCO, the logic circuit BPCL can determine the occurrence or not of a defect of a corresponding pixel and can perform a dark spot processing operation based on a defect type.

Figure 10A:
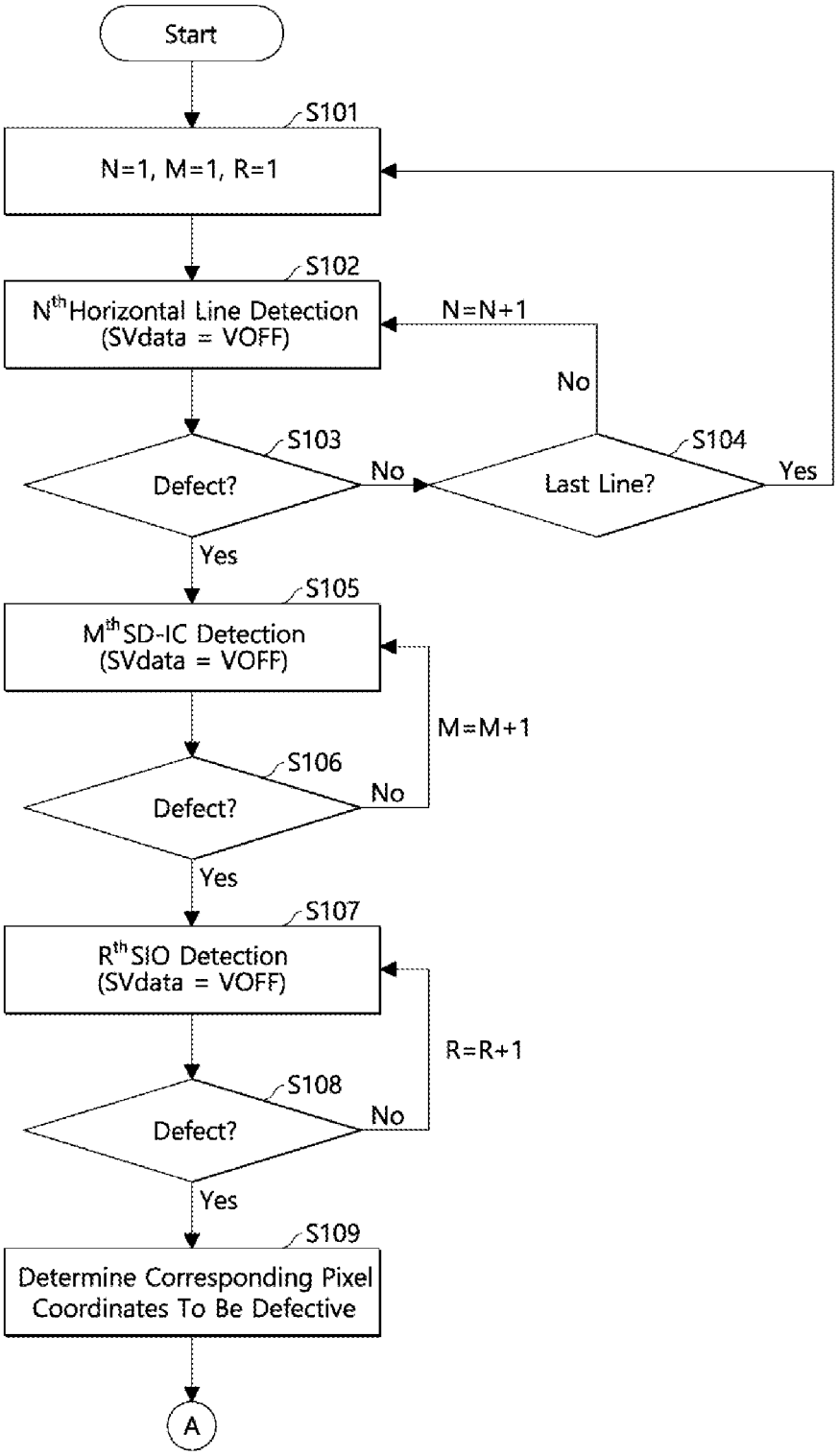
FIGS. 10A and 10B are diagrams illustrating a display defect processing method according to the first embodiment of FIG. 7.
Figure 10B:
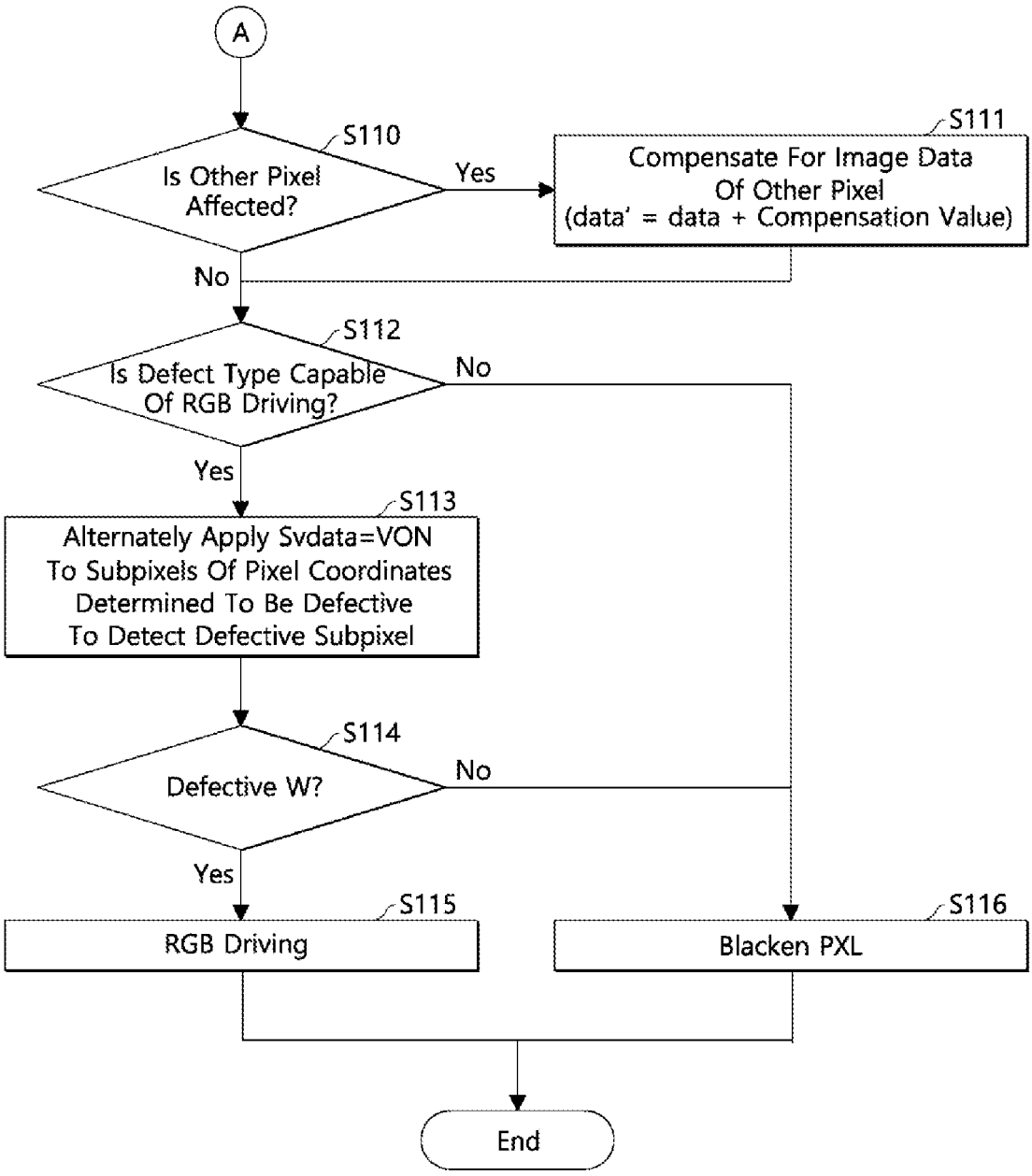
Figure 11A:
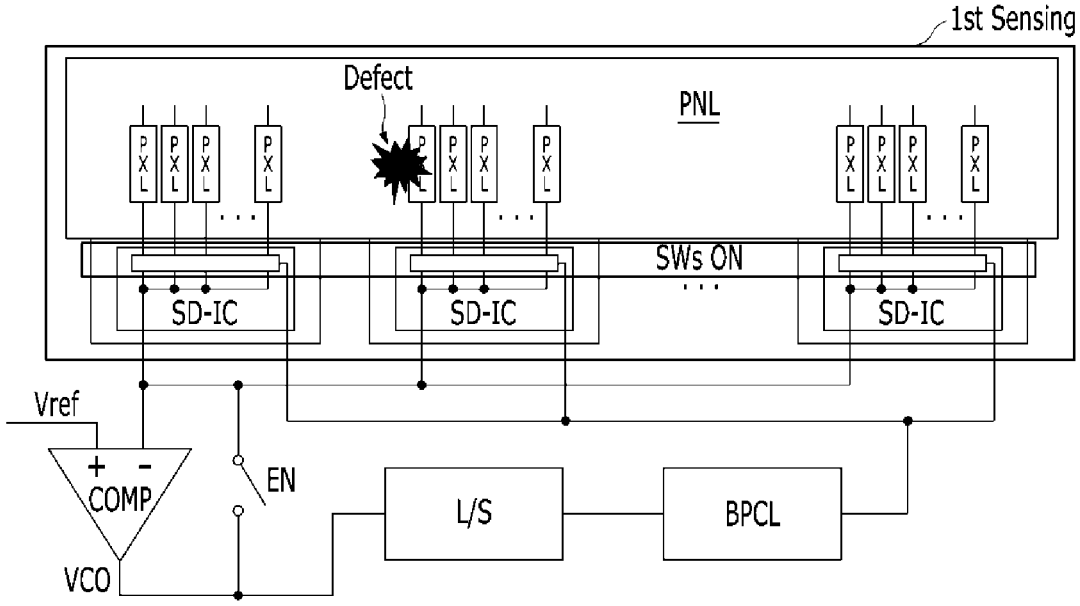
FIG. 11A is a diagram illustrating an example which detects an $N^{th}$ horizontal display line including a target pixel having a defect.
Figure 11B:
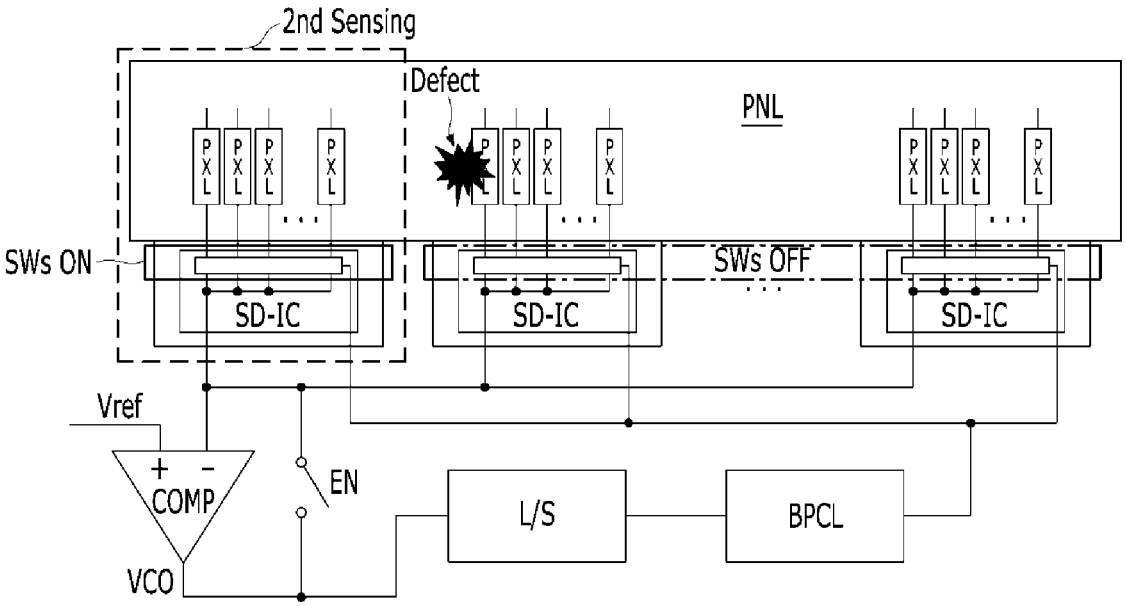
FIGS. 11B and 11C are diagrams illustrating an example which detects an $M^{th}$ source driving integrated circuit connected to the target pixel in the $N^{th}$ horizontal display line.
Figure 11C:
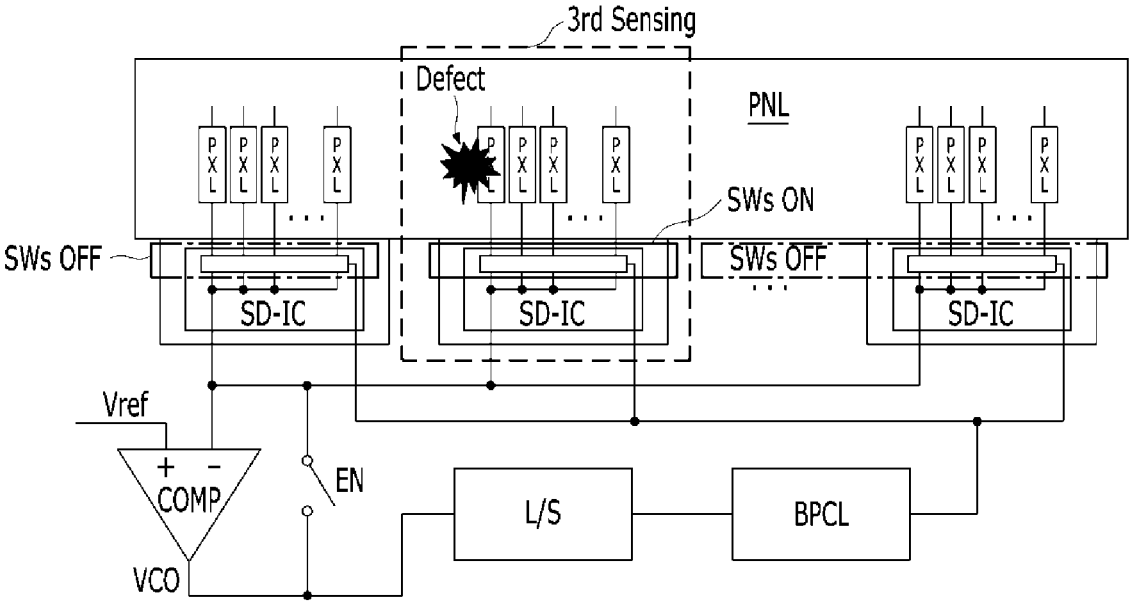
Figure 11D:
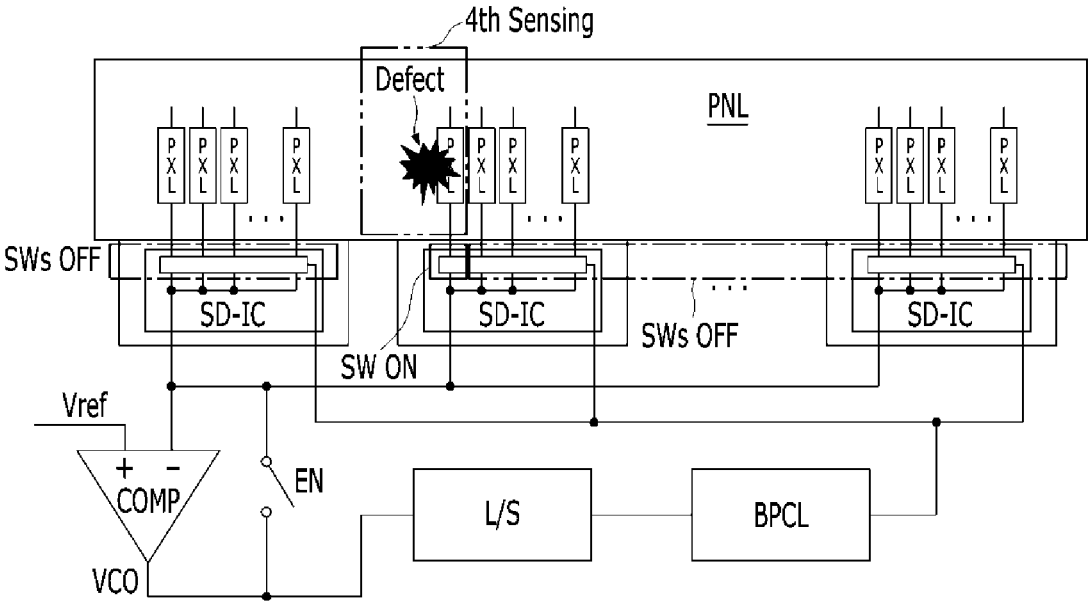
FIG. 11D is a diagram illustrating an example which detects a reference voltage line connected to the target pixel among reference voltage lines connected to the $M^{th}$ source driving integrated circuit.

Next, FIGS. 10A and 10B are diagrams illustrating a display defect processing method according to the first embodiment of FIG. 7. In addition, FIG. 11A is a diagram illustrating an example which detects an $N^{th}$ horizontal display line including a target pixel having a defect, and FIGS. 11B and 11C are diagrams illustrating an example which detects an $M^{th}$ source driving integrated circuit connected to the target pixel in the $N^{th}$ horizontal display line. Further, FIG. 11D is a diagram illustrating an example which detects a reference voltage line connected to the target pixel among reference voltage lines connected to the $M^{th}$ source driving integrated circuit.

Referring to FIGS. 10A and 11A, the display defect processing method according to the first embodiment detects a horizontal display line (hereinafter referred to as a target horizontal display line) including a defective pixel when all multiplexer switches are turned on. In addition, the display defect processing method can apply a scan signal having an on level and a detection data voltage SVdata having an off level VOFF to pixels included in each horizontal display line to detect the occurrence of a defect of each horizontal display line. Such a detection operation can be sequentially performed by one horizontal display line units and can be repeated until a target horizontal display line is detected (S101 to S104).

In addition, pixels included in the target horizontal display line can be divided by group units and be connected to a plurality of SD-ICs. Therefore, as in FIGS. 10A, 11B, and 11C, the display defect processing method according to the first embodiment can detect a pixel group (hereinafter referred to as a target pixel group) including a defective pixel when multiplexer switches are selectively turned on by one source driving IC units. In addition, the display defect processing method can apply the scan signal having the on level and the detection data voltage SVdata having the off level VOFF to pixels included in each pixel group to detect the occurrence or not of a defect of each pixel group. Such a detection operation can be sequentially performed by one pixel group units and can be repeated until a target pixel group is detected (S105 and S106).

Further, pixels included in the target pixel group can be individually connected to a plurality of detection lines SIO. Therefore, as in FIGS. 10A and 11D, the display defect processing method according to the first embodiment can detect a detection line (hereinafter referred to as a target detection line SIO) connected to a defective pixel when multiplexer switches are selectively turned on by one detection line SIO units. In addition, the display defect processing method can apply the scan signal having the on level and the detection data voltage SVdata having the off level VOFF to a pixel connected to each detection line SIO to detect the occurrence of a defect of each detection line SIO. Such a detection operation can be sequentially performed by one detection line SIO units and can be repeated until a target detection line SIO is detected (S107 and S108).

Subsequently, as shown in FIG. 10A, the display defect processing method according to the first embodiment can determine that pixel coordinates connected to the target detection line SIO are defective (S109). As shown in FIG. 10B, when a defective pixel affects luminance of another pixel, the display defect processing method according to the first embodiment can compensate for image data which is to be applied to the other pixel, and thus can prevent luminance variation affected by the defective pixel (S110 and S111).

Subsequently, as shown in FIG. 10B, when RGB driving is capable of being performed on a defect type (for example, a GS short circuit defect of a driving element), the display defect processing method according to the first embodiment can detect a defective pixel from among RGBW subpixels of pixel coordinates determined to be defective. To this end, the display defect processing method can apply a detection data voltage SVdata having an on level VON to only one of the RGBW subpixels of pixel coordinates determined to be defective when a multiplexer switch connected to the target detection line SIO is selectively turned on and can apply the detection data voltage SVdata having the off level VOFF to the other subpixels. The detection data voltage SVdata having the on level VON and the detection data voltage SVdata having the off level VOFF can be applied in synchronization with the scan signal having the on level. Such a detection operation can be repeated until a defective subpixel is detected (S112 and S113).

As shown in FIG. 10B, when a W subpixel is determined to be defective, the display defect processing method according to the first embodiment can blacken the W subpixel and implement RGB driving by using RGB subpixels (S115). The display defect processing method can increase image data, which is to be applied to the RGB subpixels, more than an input value so as to perform RGB driving. This compensates for luminance loss which occurs when the W subpixel included in the same pixel is blackened. Furthermore, as shown in FIG. 10B, when one of the RGB subpixels is determined to be defective, the display defect processing method according to the first embodiment can blacken all of the RGBW subpixels (S116).

Figure 12:
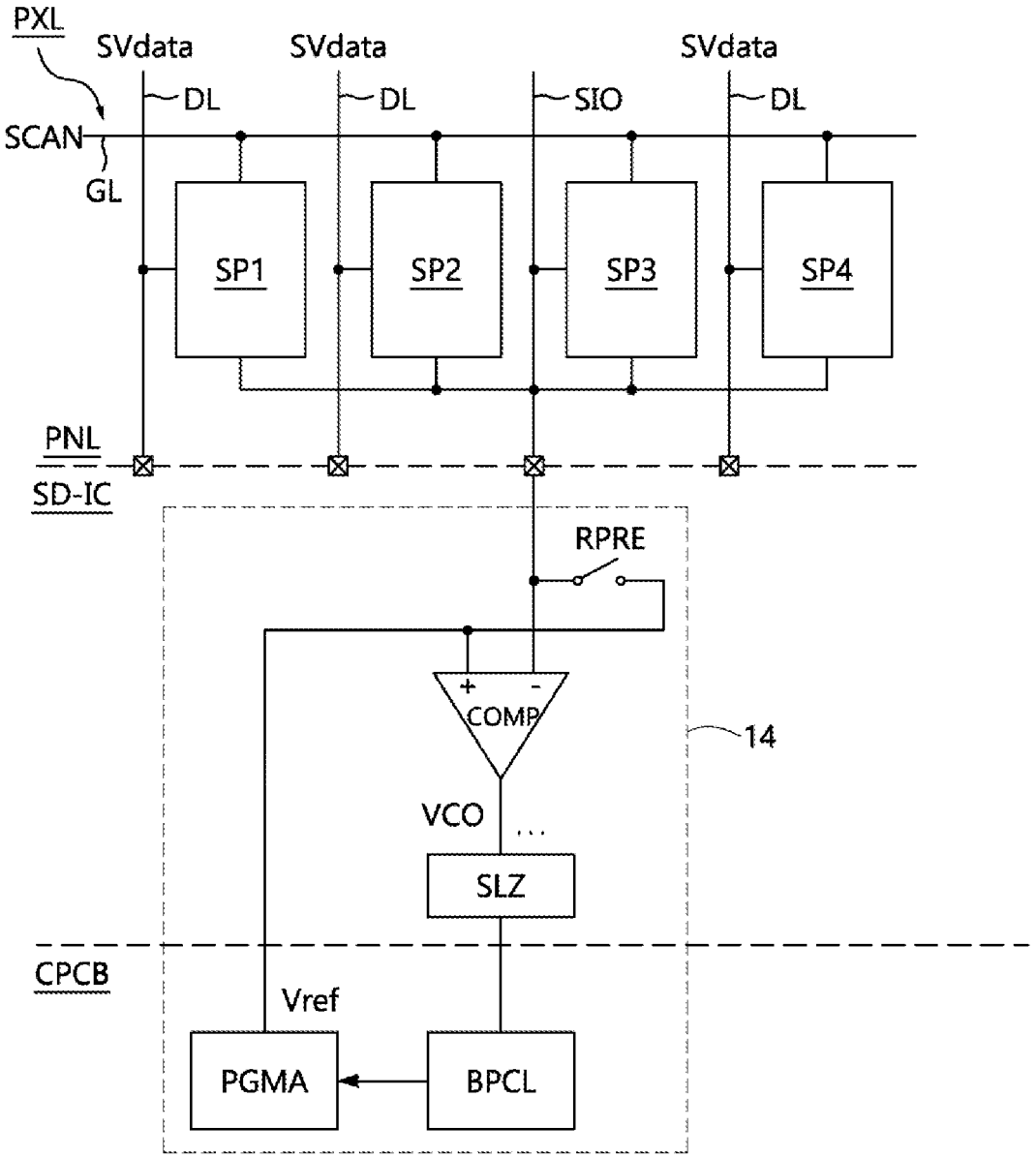
FIG. 12 is a diagram schematically illustrating a second embodiment where a comparator of a defect processing circuit is mounted on each source driving integrated circuit.

Next, FIG. 12 is a diagram schematically illustrating a second embodiment where a comparator is mounted on each source driving integrated circuit. Referring to FIG. 12, a logic circuit BPCL and a reference voltage generating circuit PGMA are mounted on a CPCB, and a comparator COMP is provided in plurality and mounted on each of SD-ICs. In this instance, the number of comparators COMP can be the same as the number of detection lines SM. In the second embodiment, unlike the first embodiment of FIG. 7, a multiplexer array can be omitted and the comparators COMP of the SD-ICs can simultaneously perform a detection operation, and thus a time taken in detection can be shortened.

Further, the comparator COMP includes a first input terminal (+) through which a first comparator reference voltage TH-HIGH and a second comparator reference voltage TH-LOW are input, a second input terminal (−) through which a voltage VSIO of a detection line SIO is input, and an output terminal where a comparator output VCO (i.e., a first comparison output VCO1 and a second comparison output VCO2) is generated.

An initialization switch RPRE can be further connected between a first input terminal (+) and a second input terminal (−) of the comparator COMP. The initialization switch RPRE can also be turned off in a detection interval and be turned on in an initialization interval preceding the detection interval. When initialization switches RPRE are simultaneously turned on in the initialization interval, the comparator COMP and the voltage VSIO of each of the detection lines SIO can be initialized to a detection reference voltage PCL from the reference voltage generating circuit PGMA.

Each of the source driving ICs SD-IC can further include a serialization circuit SLZ which is connected to output terminals of the comparators COMP in common. The serialization circuit SLZ can serialize the first comparison output VCO1 and the second comparison output VCO2 input from each of the comparators COMP, and then supply serial transfer data to the logic circuit BPCL.

Figure 13:
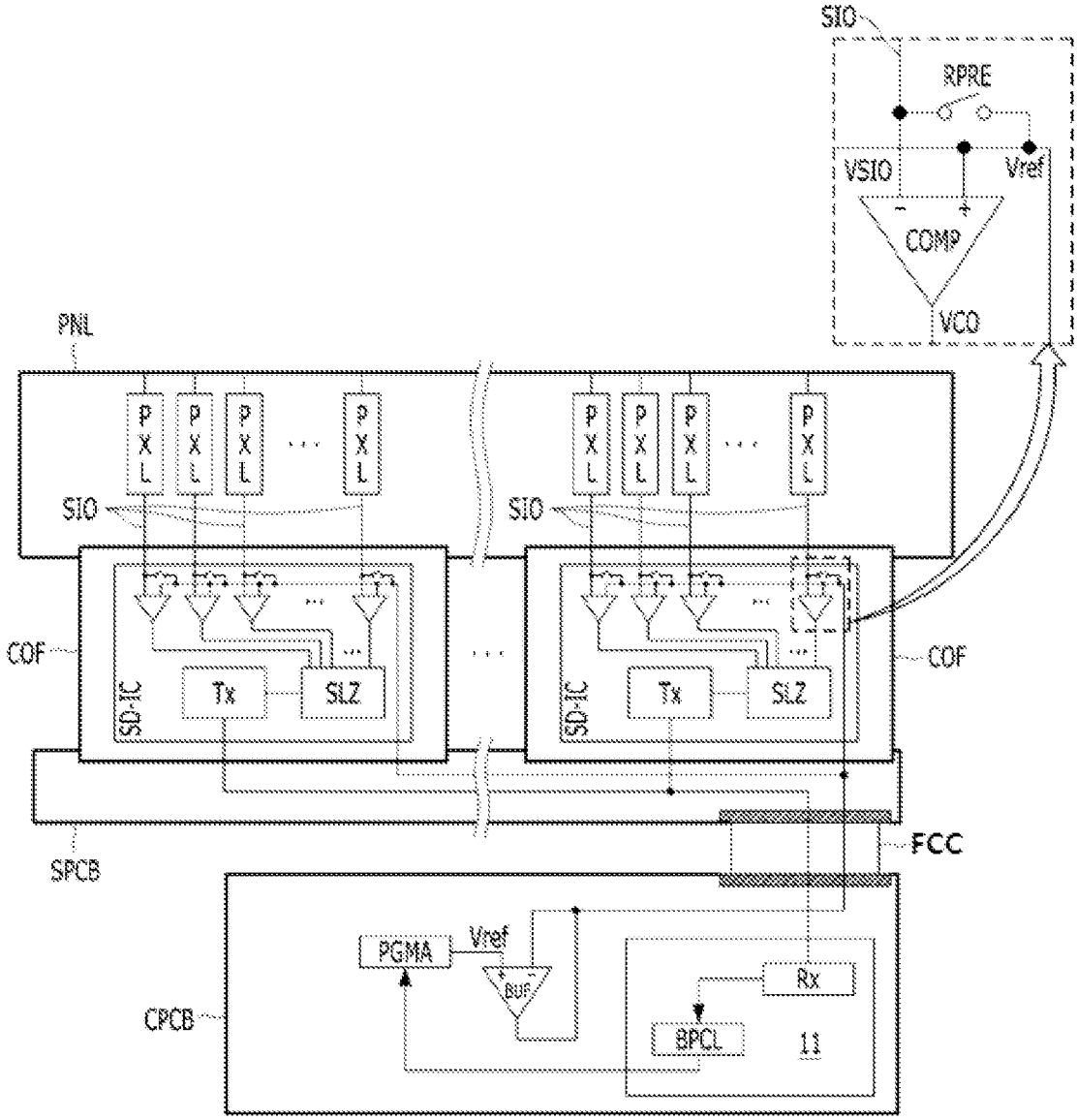
FIG. 13 is a diagram illustrating in detail a connection configuration according to the second embodiment of FIG. 12.
Figure 14:
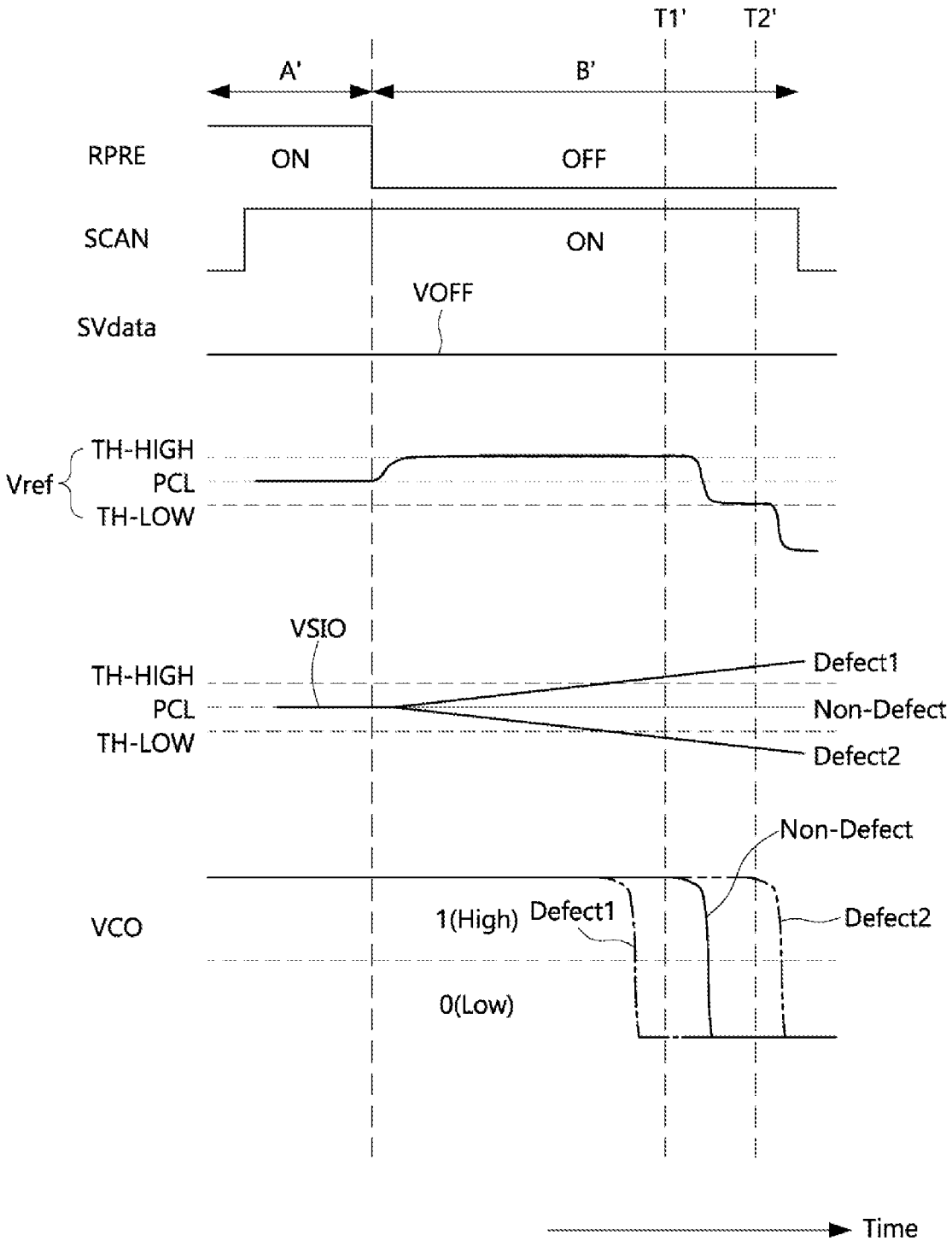
FIG. 14 is a diagram illustrating in detail a driving waveform of a connection configuration according to the second embodiment of FIG. 12.

Next, FIG. 13 is a diagram illustrating in detail a connection configuration according to the second embodiment of FIG. 12, and FIG. 14 is a diagram illustrating in detail a driving waveform of a connection configuration according to the second embodiment of FIG. 12. Referring to FIGS. 13 and 14, a display panel PNL and a source PCB (SPCB) are electrically connected to each other through a conductive film COF, and a source driving IC (SD-IC) is integrated on the conductive film COF. In addition to a data driver 12 (see FIG. 1), a serialization circuit SLZ and a transferor Tx are mounted on the SD-IC. The transferor Tx can output serial transfer data, processed by the serialization circuit SLZ, through an internal interface circuit.

In addition, the SPCB and a CPCB are electrically connected to each other through a flexible circuit cable (FCC), but are not limited thereto. The logic circuit BPCL can be provided as one body with a timing controller 11 (see FIG. 1) and be mounted on the CPCB. The timing controller 11 (see FIG. 1) can further include a receiver Rx connected to the transferor TX through an internal interface circuit. The receiver Rx can receive the serial transfer data through the internal interface circuit and can supply the serial transfer data to the logic circuit BPCL.

Comparators COMP mounted on the SD-IC can be connected to different detection lines SIO. Also, the comparator COMP can be connected to a reference voltage generating circuit PGMA. Based on control by the logic circuit BPCL, the reference voltage generating circuit PGMA can generate reference voltages Vref. The reference voltages Vref can include a detection reference voltage PCL, which is to be charged into detection lines SIO, and first and second comparator reference voltages TH-HIGH and TH-LOW for a comparison operation of the comparator COMP. A voltage buffer BUF can be further connected between an output terminal of the comparator COMP and the logic circuit BPCL. The voltage buffer BUF can buffer the reference voltages Vref and can supply the buffered reference voltages Vref to the comparator COMP.

An initialization switch RPRE is also connected between a first input terminal (+) and a second input terminal (−) of the comparator COMP can be turned on in an initialization interval A', and thus the voltage VSIO of each of the detection lines SIO and a comparator output VCO can be initialized to the detection reference voltage PCL.

In a detection interval B' succeeding the initialization interval A', a driving element of a pixel PXL connected to each of the detection lines SIO can be off-driven in response to a scan signal SCAN having an on level and a detection data voltage SVdata having an off level VOFF. In the detection interval B', a voltage VSIO of a detection line SIO connected to a normal pixel PXL can be maintained as the detection reference voltage PCL, and a voltage VSIO of a detection line SIO connected to a defective pixel PXL can increase or decrease from the detection reference voltage PCL. In the detection interval B', the comparator COMP can sequentially compare a voltage VSIO of a corresponding detection line SIO with two reference voltages Vref (i.e., a first comparator reference voltage TH-HIGH and a second comparator reference voltage TH-LOW) to generate a comparator output VCO. In addition, the comparator COMP can compare a voltage VSIO of a corresponding detection line SIO with the first comparator reference voltage TH-HIGH to generate a first comparison output VCO1 at a first timing T1' of the detection interval B', and then, can compare a voltage VSIO of a corresponding detection line SIO with the second comparator reference voltage TH-LOW to generate a second comparison output VCO2 at a second timing T2' of the detection interval B'. As shown in FIG. 6 described above, a logic combination of the first comparison output VCO1 and the second comparison output VCO2 included in the comparator output VCO, the logic circuit BPCL can determine the occurrence or not of a defect of a corresponding pixel and can perform a dark spot processing operation based on a defect type.

Figure 15:
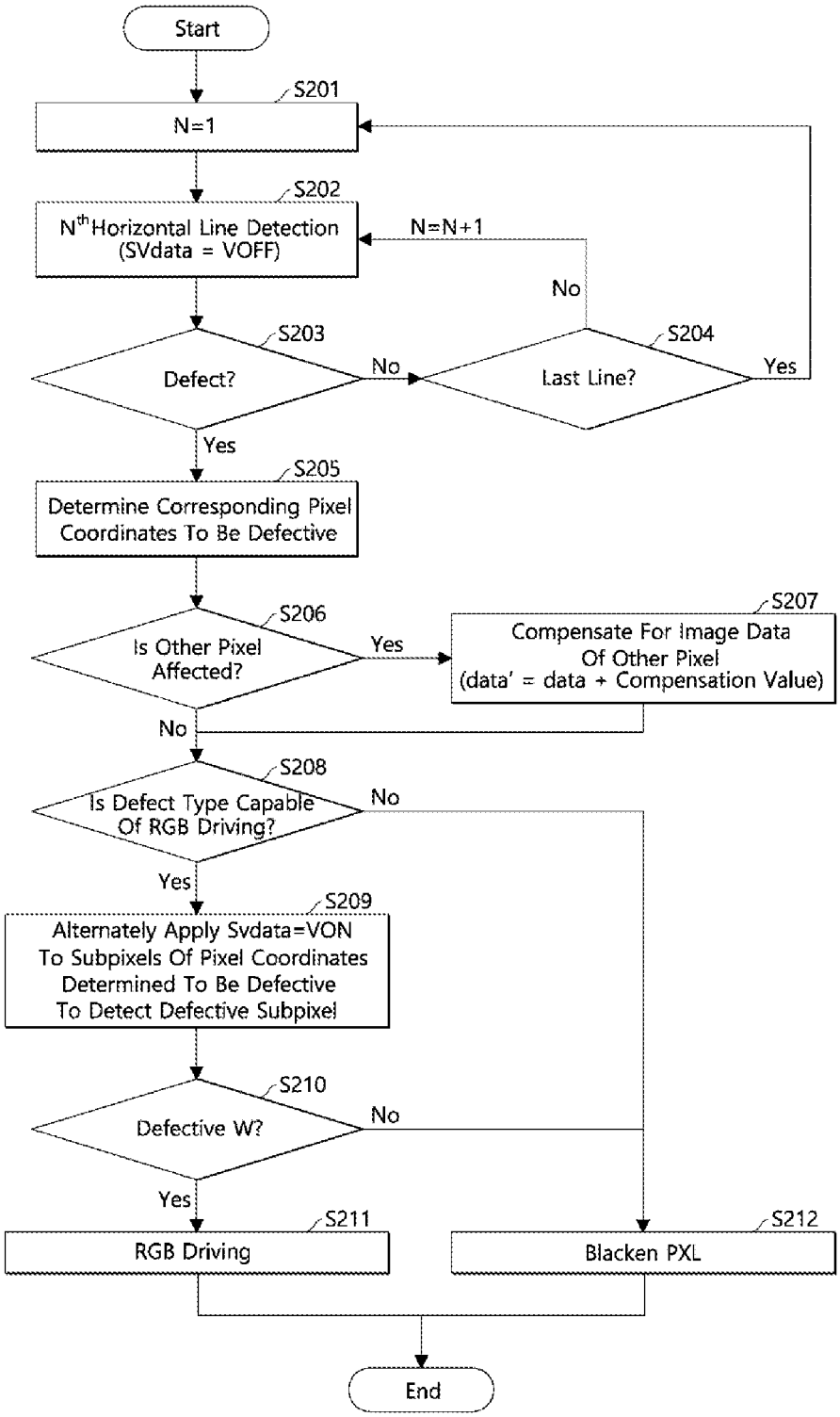
FIG. 15 is a diagram illustrating a display defect processing method according to the second embodiment of FIG. 12.

Next, FIG. 15 is a diagram illustrating a display defect processing method according to the second embodiment of FIG. 12. Referring to FIG. 15, the display defect processing method according to the second embodiment can detect a horizontal display line (hereinafter referred to as a target horizontal display line) including a defective pixel by using all comparators. In addition, the display defect processing method can apply a scan signal having an on level and a detection data voltage SVdata having an off level VOFF to pixels included in each horizontal display line to detect the occurrence or not of a defect of each horizontal display line. Such a detection operation can be sequentially performed by one horizontal display line units and can be repeated until a target horizontal display line is detected (S201 to S204).

When the target horizontal display line is detected, the occurrence of a defect of each pixel configuring the target horizontal display line can be detected. Accordingly, as shown in FIG. 15, the display defect processing method according to the second embodiment can calculate coordinates of a defective pixel (S205).

Subsequently, as shown in FIG. 15, when a defective pixel affects luminance of another pixel, the display defect processing method according to the second embodiment can compensate for image data which is to be applied to the other pixel, and thus, can prevent luminance variation affected by the defective pixel (S206 and S207). Then, when RGB driving is capable of being performed on a defect type (for example, a GS short circuit defect of a driving element), the display defect processing method according to the second embodiment can detect a defective pixel from among RGBW subpixels of pixel coordinates determined to be defective. In addition the display defect processing method can apply a detection data voltage SVdata having an on level VON to only one of the RGBW subpixels of pixel coordinates determined to be defective and can apply the detection data voltage SVdata having the off level VOFF to the other subpixels. The detection data voltage SVdata having the on level VON and the detection data voltage SVdata having the off level VOFF can be applied in synchronization with the scan signal having the on level. Such a subpixel detection operation can be repeated until a defective subpixel is detected (S208 and S209).

As shown in FIG. 15, when a W subpixel is determined to be defective, the display defect processing method according to the second embodiment can blacken the W subpixel and can implement RGB driving by using RGB subpixels (S211). The display defect processing method can more increase image data, which is to be applied to the RGB subpixels, than an input value so as to perform RGB driving. This can be for compensating for luminance loss which occurs when the W subpixel included in the same pixel is blackened. Furthermore, as shown in FIG. 15, when one of the RGB subpixels is determined to be defective, the display defect processing method according to the second embodiment can blacken all of the RGBW subpixels (S212).

Figure 16:
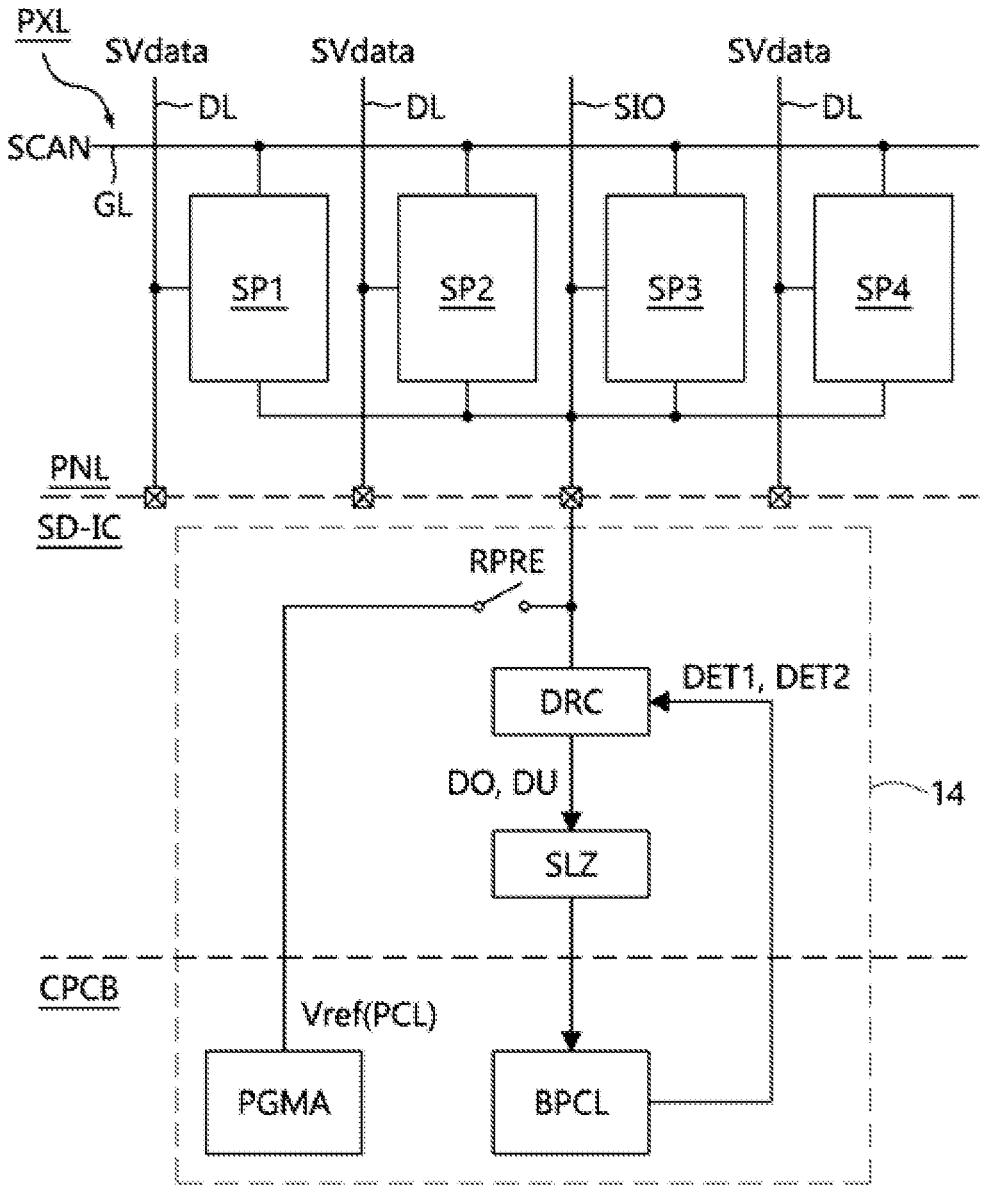
FIG. 16 is a diagram illustrating a connection configuration between a pixel and a detect processing circuit according to another embodiment of the present disclosure.

Next, FIG. 16 is a diagram illustrating a connection configuration between a pixel PXL and a detect processing circuit 14 according to another embodiment of the present disclosure. Referring to FIG. 16, a detection operation of the defect processing circuit 14 can be performed while driving elements are being turned off. The defect processing circuit 14 can include a reference voltage generating circuit PGMA, a dynamic logic circuit DRC, a serialization circuit SLZ, and a logic circuit BPCL.

The reference voltage generating circuit PGMA and the logic circuit BPCL can be mounted on a control PCB, and the dynamic logic circuit DRC and the serialization circuit SLZ can be embedded in a source driving IC. Because a static current does not flow in the dynamic logic circuit DRC, power consumption can be low. Because the dynamic logic circuit DRC is configured as a simple logic gate circuit, a circuit size can be small. The dynamic logic circuit DRC can be implemented to have a small size, and thus can be easily embedded in the source driving IC.

In addition, the reference voltage generating circuit PGMA can apply the detection reference voltage PCL to the detection line SIO in an initialization interval preceding a detection interval. When a short circuit defect of a subpixel occurs in the pixel PXL, a voltage VSIO of the detection line SIO may not be maintained as the detection reference voltage PCL in the detection interval and can increase or decrease from the detection reference voltage PCL.

Further, the dynamic logic circuit DRC can include a first output node and a second output node connected between a high level power and a low level power, and the dynamic logic circuit DRC can generate a first logic output through the first output node and can generate a second logic output through the second output node. In the detection interval, the first logic output and the second logic output can vary based on a voltage of the detection line SIO shifted from the detection reference voltage PCL.

In addition, the serialization circuit SLZ can serialize the first logic output and the second logic output which are output from the dynamic logic circuit DRC, and can supply serial transfer data to the logic circuit BPCL. The logic circuit BPCL can determine the occurrence or not of a defect in a pixel, based on the first logic output and the second logic output obtained in the detection interval. The logic circuit BPCL can determine the occurrence or not of a defect in a pixel, based on a logic combination of the first logic output and the second logic output obtained in the detection interval. The logic combination of the first logic output and the second logic output can be one of (0,0), (1,0), and (1,1) as illustrated in FIG. 23.

In addition, the logic circuit BPCL can determine that the pixel PXL is normal, based on the logic combination (1,0). The logic circuit BPCL can determine that the pixel PXL is a defect having a defect 1 of an overflow type, based on the logic combination (0,0). The logic circuit BPCL can determine that the pixel PXL is a defect having a defect 2 of an underflow type, based on the logic combination (1,1). The defect 1 of the overflow type and the defect 2 of the underflow type can be as described above with reference to FIG. 6.

Further, the logic circuit BPCL can output a defect compensation signal (BPC of FIG. 1) based on a defective pixel PXL, and thus dark spot processing can be processed on the defective pixel PXL based on the defect compensation signal. The logic circuit BPCL can generate a first switching control signal DET1 and a second switching control signal DET2 needed for an operation of the dynamic logic circuit DRC. The logic circuit BPCL can be embedded in a timing controller.

Figure 17:
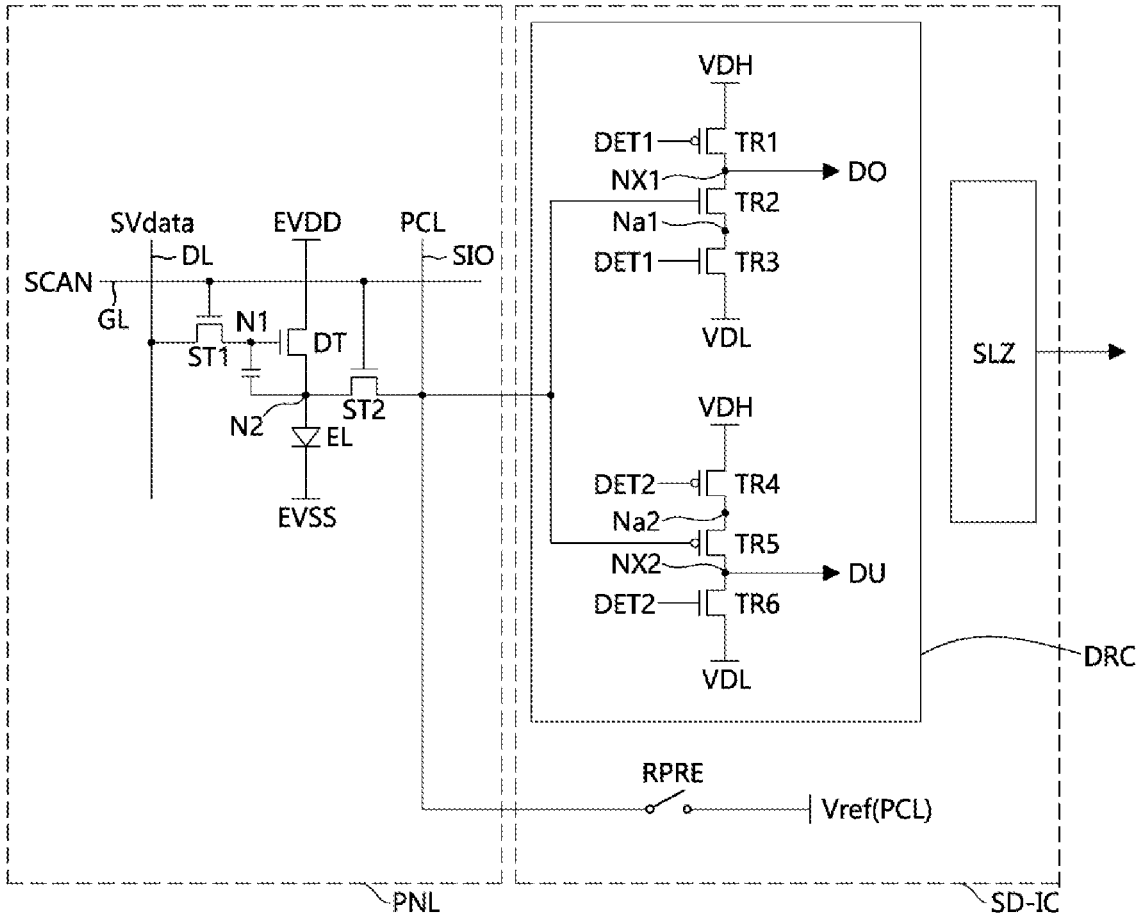
FIG. 17 is a diagram illustrating a detailed connection configuration between a pixel and a dynamic logic circuit included in the detect processing circuit of FIG. 16.

Next, FIG. 17 is a diagram illustrating a detailed connection configuration between a pixel PXL and a dynamic logic circuit DRC included in the detect processing circuit 14 of FIG. 16. In addition, FIG. 18 is a diagram showing a driving waveform of the pixel PXL and the detect processing circuit 14 of FIG. 17.

Figure 18:
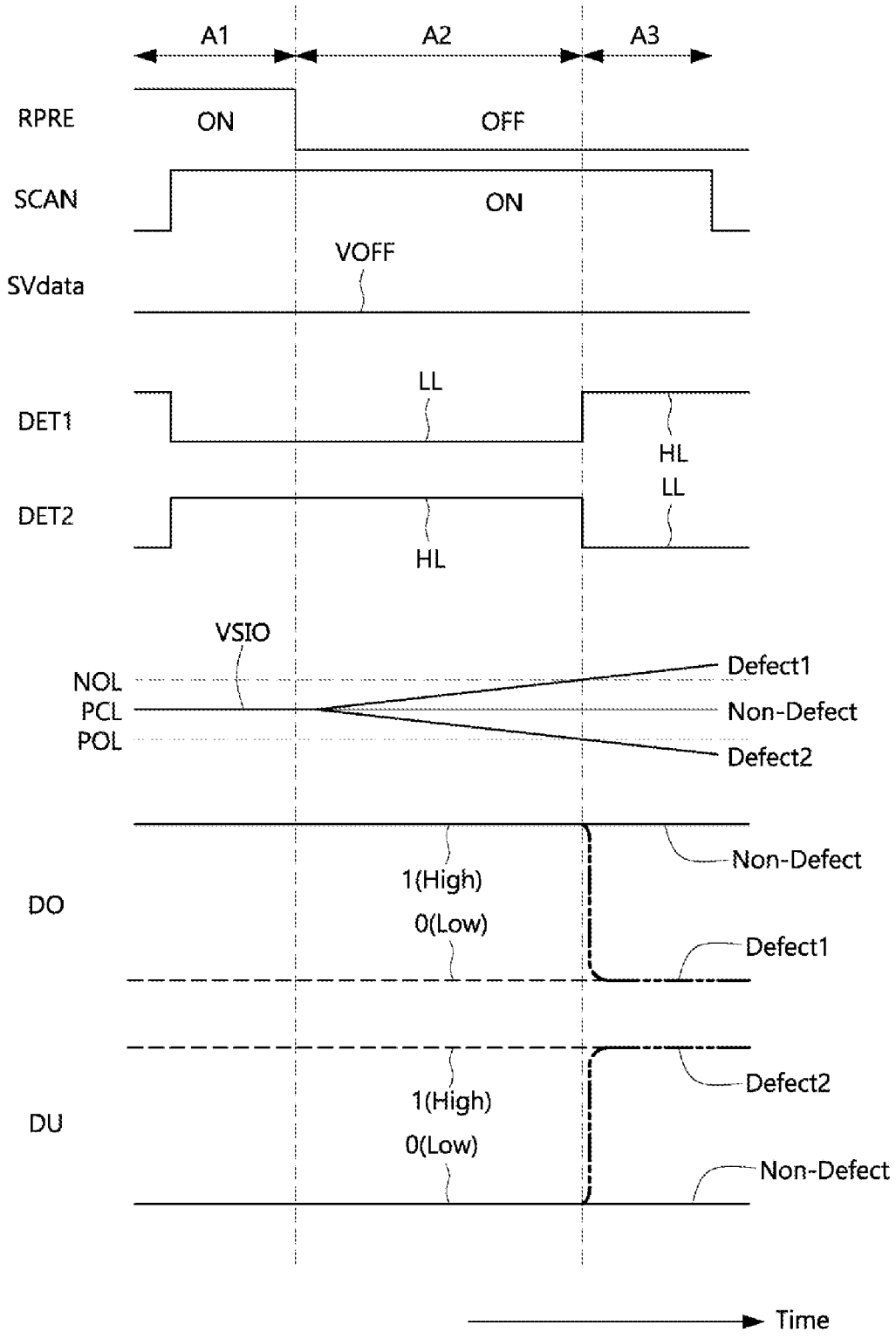
FIG. 18 is a diagram showing a driving waveform of the pixel and the detect processing circuit of FIG. 17.

Referring to FIGS. 17 and 18, the dynamic logic circuit DRC includes first to third transistors TR1 to TR3 for generating a first logic output DO through a first output node NX1 and fourth to sixth transistors TR4 to TR6 for generating a second logic output DU through a second output node NX2. The first to third transistors TR1 to TR3 can be connected serially between a high level power VDH and a low level power VDL. In addition, the first transistor TR1 is connected between the high level power VDH and a first output node NX1 and can be turned on based on the first switching control signal DET1. As shown, the second transistor TR2 is connected between the first output node NX1 and a first connection node Na1 and can be turned on based on a voltage VSIO of a detection line SIO. Further, the third transistor TR3 is connected between the first connection node Na1 and the low level power VDL and can be turned on based on the first switching control signal DET1. The first transistor TR1 can also be a P-type transistor, and each of the second and third transistors TR2 and TR3 can be an N-type transistor.

In addition, the fourth to sixth transistors TR4 to TR6 can be connected serially between the high level power VDH and the low level power VDL. In particular, the fourth transistor TR4 is connected between the high level power VDH and a second connection node Na2 and can be turned on based on the second switching control signal DET2. The fifth transistor TR5 is also connected between the second output node NX2 and a second connection node Na2 and can be turned on based on the voltage VSIO of the detection line SIO. The sixth transistor TR6 is connected between the second output node NX2 and the low level power VDL and can be turned on based on the second switching control signal DET2. Each of the fourth and fifth transistors TR4 and TR5 can be a P-type transistor, and the sixth transistor TR6 can be an N-type transistor.

Further, the first switching control signal DET1 and the second switching control signal DET2 can have opposite phases. An initialization switch RPRE is connected between the detection line SIO and the reference voltage generating circuit PGMA. The initialization switch RPRE can be turned on in an initialization interval A1 and be turned off in a pre-charge interval A2 and a detection interval A3. When the initialization switch RPRE is turned on in the initialization interval A1, the voltage VSIO of the detection line SIO can be initialized to a detection reference voltage PCL. In addition, the panel driving circuit can supply the pixel PXL with the scan signal SCAN having an on level and the detection data voltage SVdata having an off level in the initialization interval A1, the pre-charge interval A2, and the detection interval A3 to off-drive driving elements included in the pixel PXL.

Figure 19:
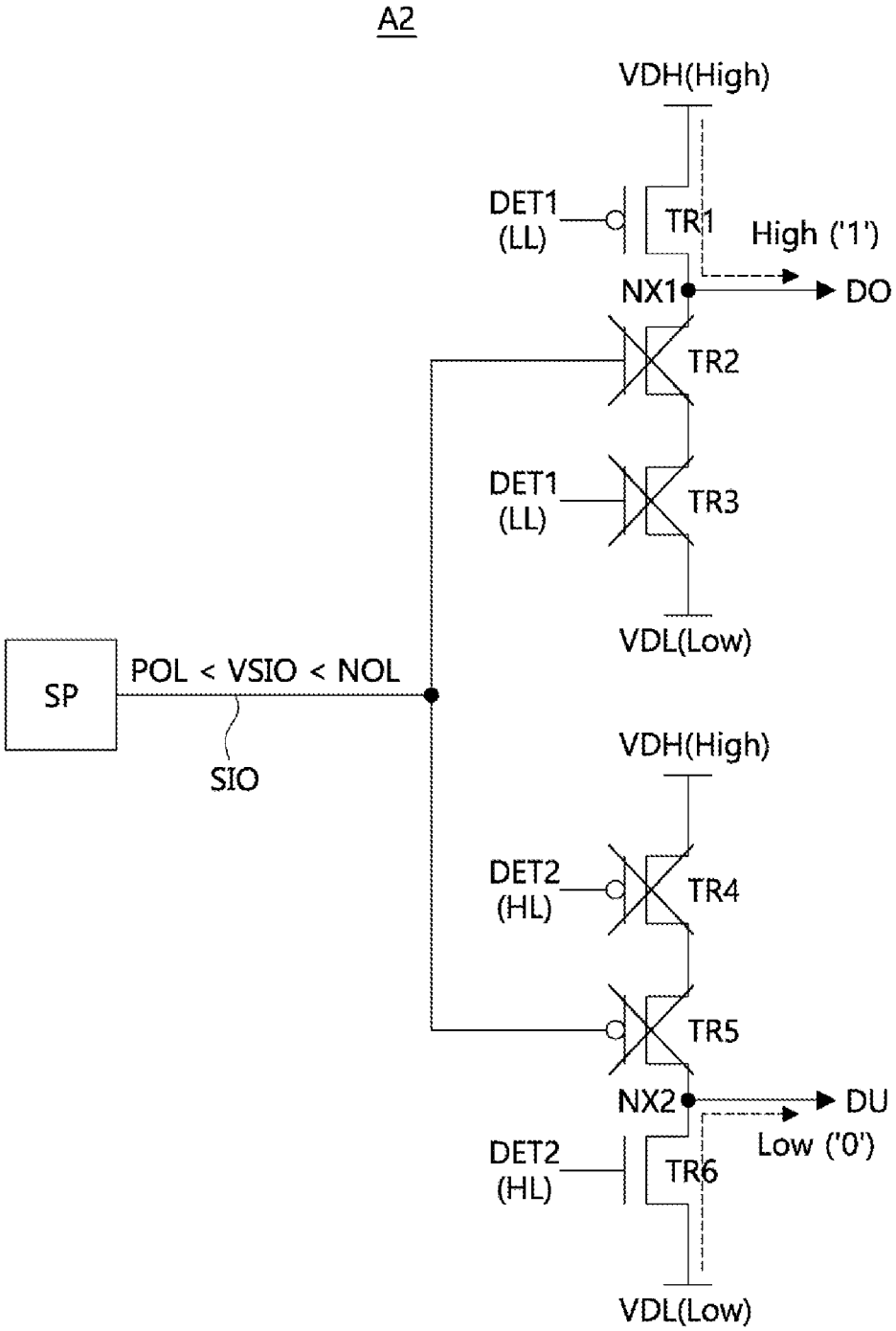
FIG. 19 is a diagram showing a pre-charge operation of a dynamic logic circuit performed in a pre-charge interval of FIG. 18.
Figure 20:
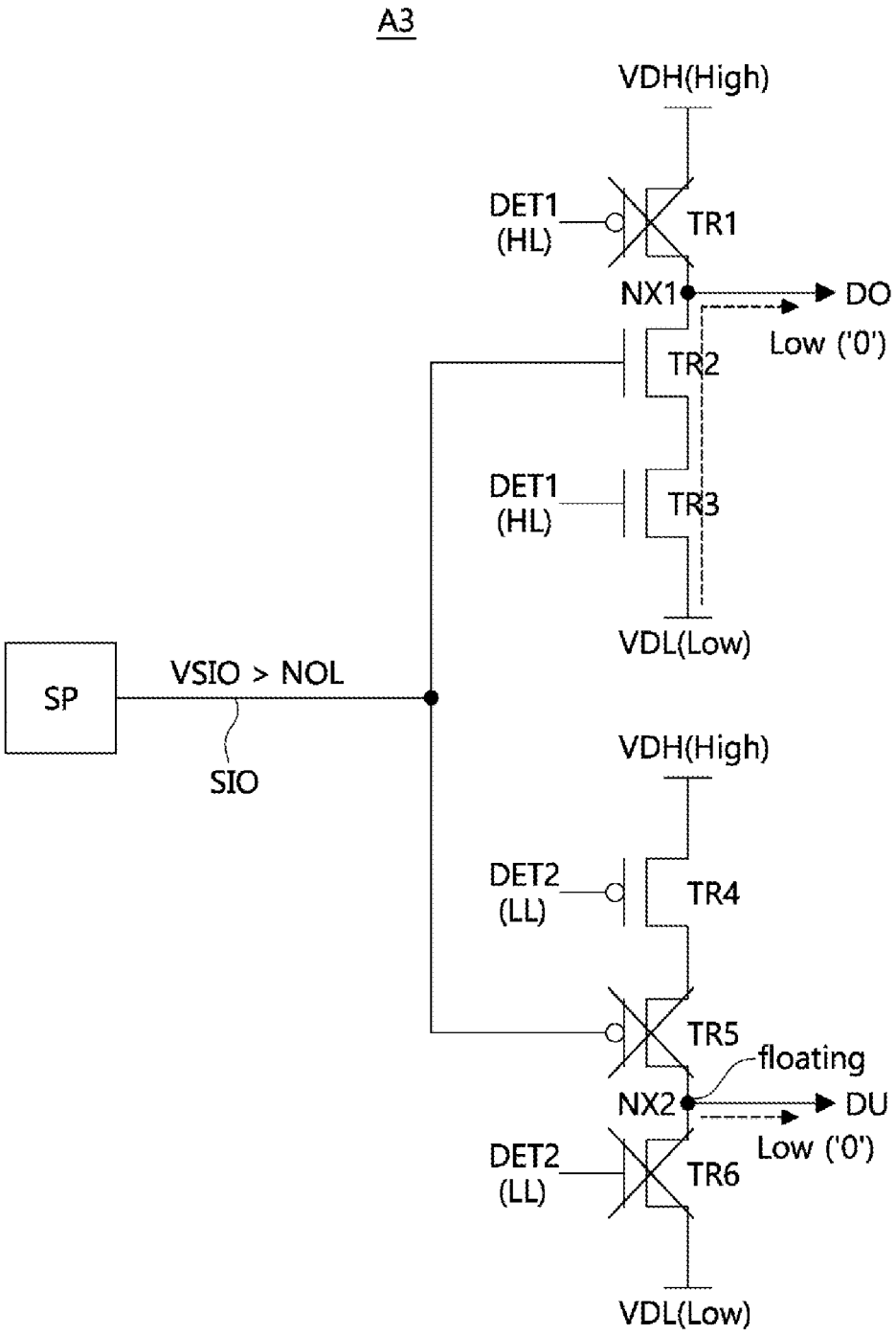
FIG. 20 is a diagram showing a first detection operation of a dynamic logic circuit performed in a detection interval of FIG. 18.
Figure 21:
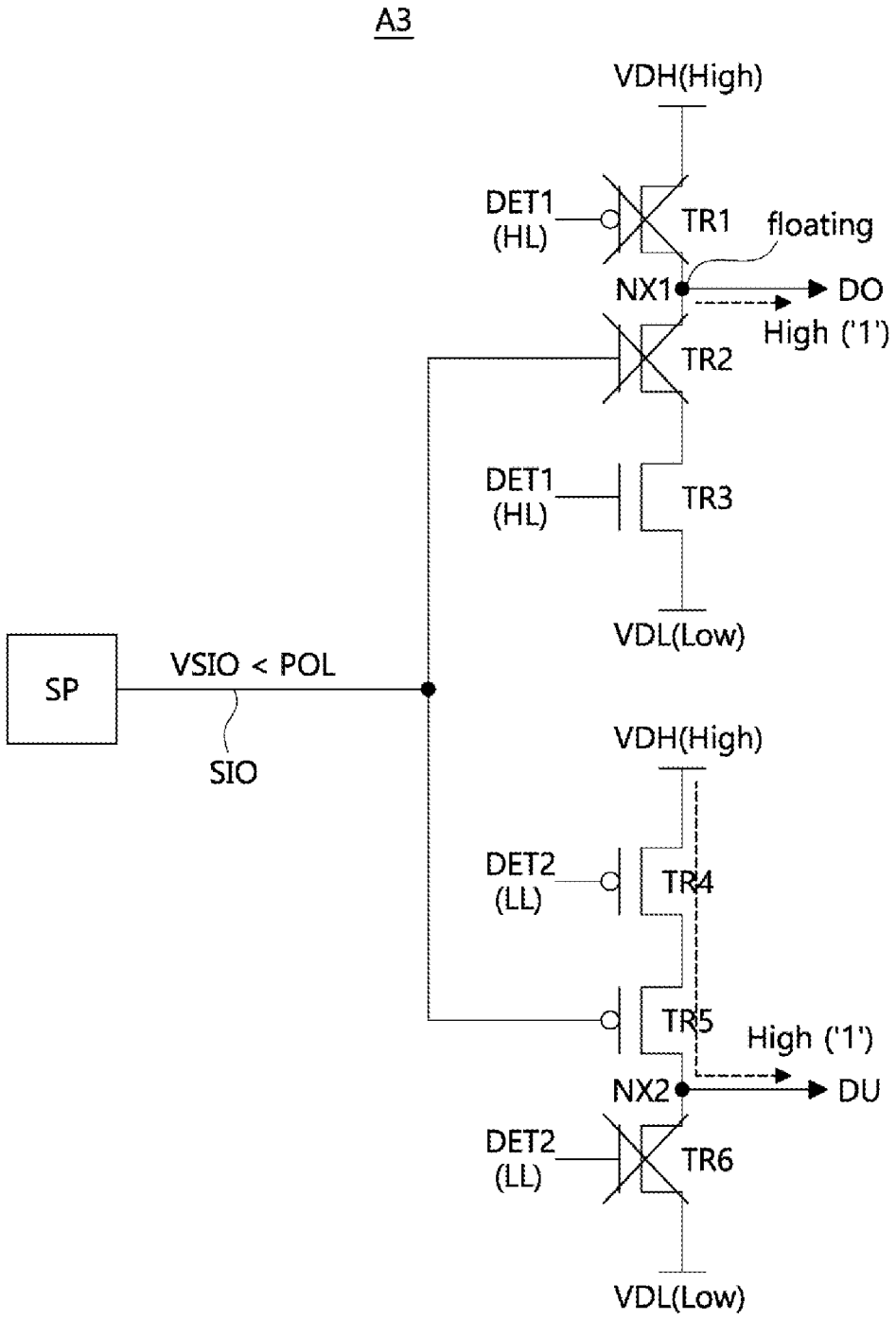
FIG. 21 is a diagram showing a second detection operation of a dynamic logic circuit performed in a detection interval of FIG. 18.
Figure 22:
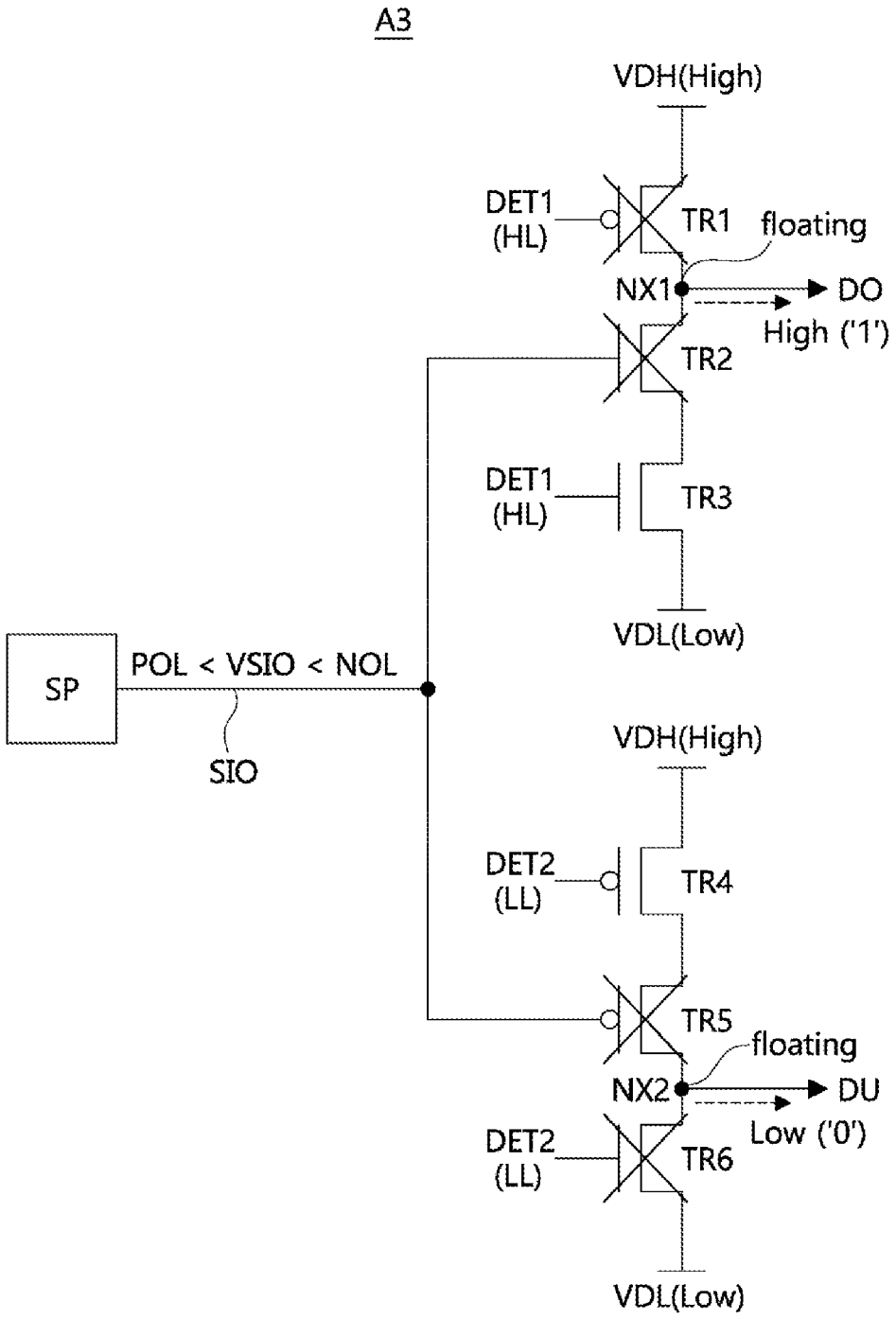
FIG. 22 is a diagram showing a third detection operation of a dynamic logic circuit performed in a detection interval of FIG. 18.

Next, FIG. 19 is a diagram showing a pre-charge operation of a dynamic logic circuit performed in the pre-charge interval of FIG. 18, and FIG. 20 is a diagram showing a first detection operation of a dynamic logic circuit performed in the detection interval of FIG. 18. In addition, FIG. 21 is a diagram showing a second detection operation of a dynamic logic circuit performed in the detection interval of FIG. 18, and FIG. 22 is a diagram showing a third detection operation of a dynamic logic circuit performed in the detection interval of FIG. 18. Also, FIG. 23 is a diagram showing an output of a dynamic logic circuit of a defect processing circuit with respect to a defect type.

Referring to FIGS. 18 and 19, in a pre-charge interval A2, a voltage VSIO of a detection line is higher than a threshold voltage POL of a P-type transistor and is lower than a threshold voltage NOL of an N-type transistor. As a result, in the pre-charge interval A2, the second and fifth transistors TR2 and TR5 are turned off.

Referring to FIGS. 18 and 19, in the pre-charge interval A2, the first switching control signal DET1 maintains a low voltage level LL which is lower than a threshold voltage POL of a P-type transistor, and the second switching control signal DET2 maintains a high voltage level HL which is higher than a threshold voltage NOL of an N-type transistor. As a result, in the pre-charge interval A2, the first and sixth transistors TR1 and TR6 are turned on, and the third and fourth transistors TR3 and TR4 are turned off.

Referring to FIGS. 18 and 19, in the pre-charge interval A2, because the first and sixth transistors TR1 and TR6 are turned on, a high output based on the high level power VDH is pre-charged into the first output node NX1, and a low output based on the low level power VDL is pre-charged into the second output node NX2. For convenience, the high output can be expressed as '1', and the low output can be expressed as '0'.

Referring to FIGS. 20 to 22, in a detection interval A3, the first switching control signal DET1 maintains a high voltage level HL which is higher than a threshold voltage of an N-type transistor, and the second switching control signal DET2 maintains a low voltage level LL which is lower than a threshold voltage of a P-type transistor. As a result, in the detection interval A3, the third and fourth transistors TR3 and TR4 maintains an on state, and the first and sixth transistors TR1 and TR6 maintains an off state.

In the detection interval A3, the second and fifth transistors TR2 and TR5 are selectively turned on based on the voltage VSIO of the detection line as in FIGS. 20 and 21, or are turned off as in FIG. 22. In more detail, referring to FIGS. 18, 20, and 23, when a pixel PXL has the defect 1 of the overflow type, the voltage VSIO of the detection line is higher than the threshold voltage NOL of the N-type transistor. In this instance, the second transistor TR2 is turned on, and the fifth transistor TR5 is turned off. As a result, the first output node NX1 is connected to the low level power VDL through the second and third transistors TR2 and TR3, and a first logic output DO is shifted from the pre-charged high output '1' to the low output '0'. On the other hand, because the second output node NX2 is floated, a second logic output DU is maintained as the pre-charged low output '0'.

Referring to FIGS. 18, 21, and 23, when the pixel PXL has the defect 2 of the underflow type, the voltage VSIO of the detection line is lower than the threshold voltage POL of the P-type transistor. In this instance, the second transistor TR2 is turned off, and the fifth transistor TR5 is turned on. As a result, the second output node NX2 is connected to the high level power VDH through the fourth and fifth transistors TR4 and TR5, and the second logic output DU is shifted from the pre-charged low output '0' to the high output '1'. On the other hand, because the first output node NX1 is floated, the first logic output DO is maintained as the pre-charged high output '1'.

Referring to FIGS. 18, 22, and 23, when the pixel PXL is normal, the voltage VSIO of the detection line is higher than the threshold voltage POL of the P-type transistor and lower than the threshold voltage NOL of the N-type transistor in the detection interval A3. In this instance, the second and fifth transistors TR2 and TR5 is turned off. As a result, because the first output node NX1 is floated, the first logic output DO is maintained as the pre-charged high output '1'. Likewise, because the second output node NX2 is floated, the second logic output DU is maintained as the pre-charged low output '0'.

Figure 24:
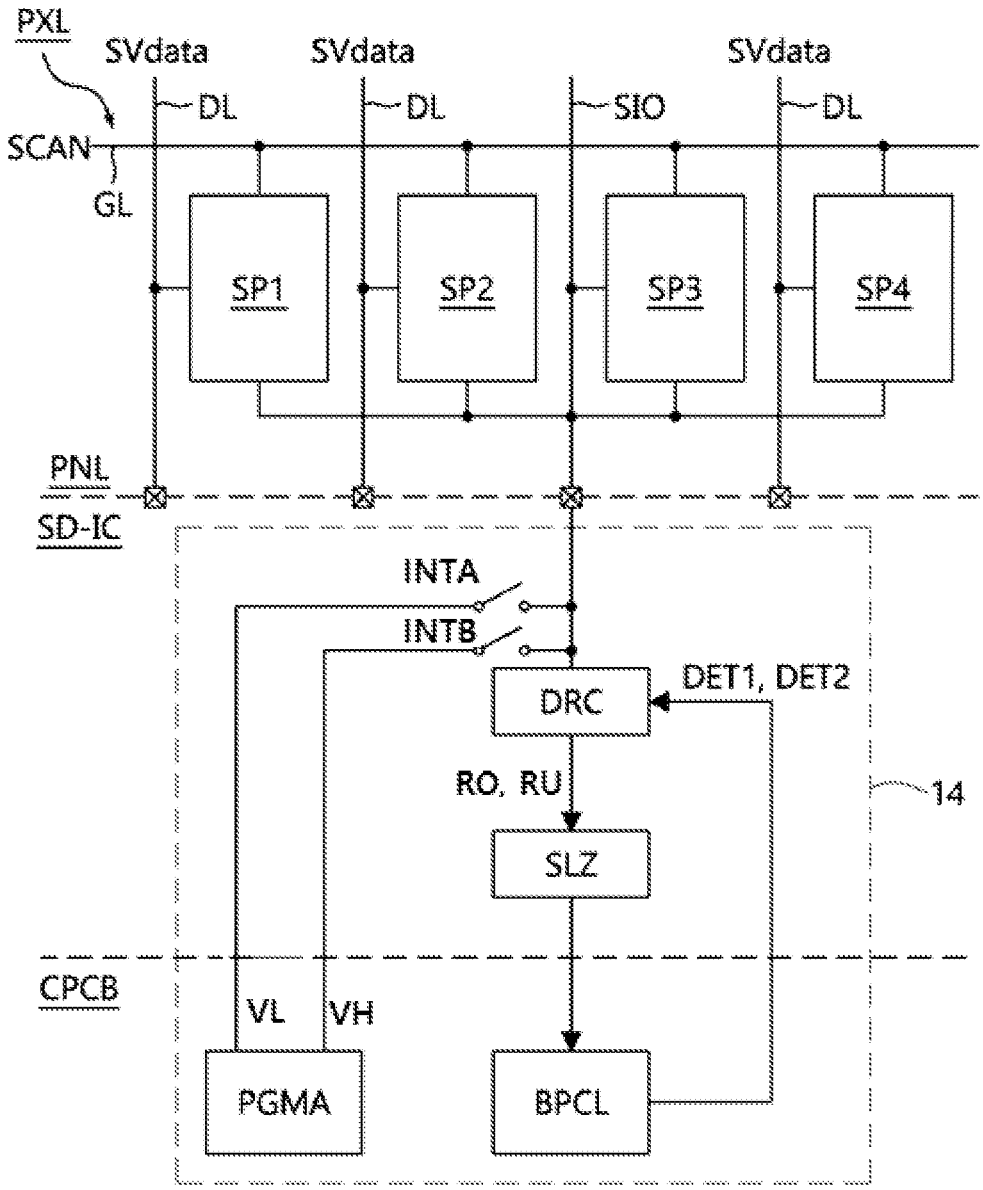
FIG. 24 is a diagram illustrating a connection configuration between a pixel and a detect processing circuit according to another embodiment of the present disclosure.

Next, FIG. 24 is a diagram illustrating a connection configuration between a pixel and a detect processing circuit 14 according to another embodiment of the present disclosure. Referring to FIG. 24, a detection operation of the defect processing circuit 14 can be performed while driving elements are being off-driven. As shown, the defect processing circuit 14 includes a reference voltage generating circuit PGMA, a dynamic logic circuit DRC, a serialization circuit SLZ, and a logic circuit BPCL.

The reference voltage generating circuit PGMA and the logic circuit BPCL is mounted on a control PCB, and the dynamic logic circuit DRC and the serialization circuit SLZ is embedded in a source driving IC SD-IC. Because a static current does not flow in the dynamic logic circuit DRC, power consumption is low. Because the dynamic logic circuit DRC is configured as a simple logic gate circuit, a circuit size can be small. The dynamic logic circuit DRC can be implemented to have a small size, and thus, can be easily embedded in the source driving IC.

In addition, the reference voltage generating circuit PGMA can apply a first detection reference voltage VL to a detection line SIO through a first initialization switch INTA in a first initialization interval preceding a first detection interval. The reference voltage generating circuit PGMA can apply a second detection reference voltage VH, which is higher than the first detection reference voltage VL, to the detection line SIO through a second initialization switch INTB in a second initialization interval preceding a second detection interval. When a short circuit defect occurs in a pixel PXL, a voltage of the detection line SIO is not maintained as the first detection reference voltage VL in the first detection interval and increases from the first detection reference voltage VL. When a short circuit defect occurs in the pixel PXL, the voltage of the detection line SIO is not maintained as the second detection reference voltage VH in the second detection interval and decreases from the second detection reference voltage VH.

Further, the dynamic logic circuit DRC includes a first output node and a second output node connected between a high level power and a low level power, and the dynamic logic circuit DRC generates a first logic output through the first output node and generates a second logic output through the second output node. In the first detection interval, the first logic output varies based on the voltage of the detection line SIO. In the second detection interval, the second logic output varies based on the voltage of the detection line SIO.

In addition, the serialization circuit SLZ can serialize the first logic output and the second logic output which are output from the dynamic logic circuit DRC, and then supply serial transfer data to the logic circuit BPCL. The logic circuit BPCL can determine the occurrence of a defect in a pixel, based on the first logic output obtained in the first detection interval and the second logic output obtained in the second detection interval. The logic circuit BPCL can also determine the occurrence of a defect in a pixel, based on a variation of the first logic output obtained in the first initialization interval and the first detection interval. Further, the logic circuit BPCL can determine the occurrence of a defect in a pixel, based on a variation of the second logic output obtained in the second initialization interval and the second detection interval.

When a first logic output in the first initialization interval differs from a first logic output in the first detection interval, the logic circuit BPCL can determine a defect where the pixel PXL has a defect 1 of an overflow type. When a second logic output in the second initialization interval differs from a second logic output in the second detection interval, the logic circuit BPCL can determine a defect where the pixel PXL has a defect 2 of an underflow type. On the other hand, when it is maintained that the first logic output in the first initialization interval is the same as the first logic output in the first detection interval and the second logic output in the second initialization interval is the same as the second logic output in the second detection interval, the logic circuit BPCL can determine that the pixel PXL is normal. The defect 1 of the overflow type and the defect 2 of the underflow type can be as described above with reference to FIG. 6.

In addition, the logic circuit BPCL can output a defect compensation signal (BPC of FIG. 1) based on a defective pixel PXL, and thus dark spot processing can be processed on the defective pixel PXL based on the defect compensation signal. Also, the logic circuit BPCL can generate a first switching control signal DET1 and a second switching control signal DET2 needed for an operation of the dynamic logic circuit DRC. The logic circuit BPCL can also be embedded in a timing controller.

Figure 25:
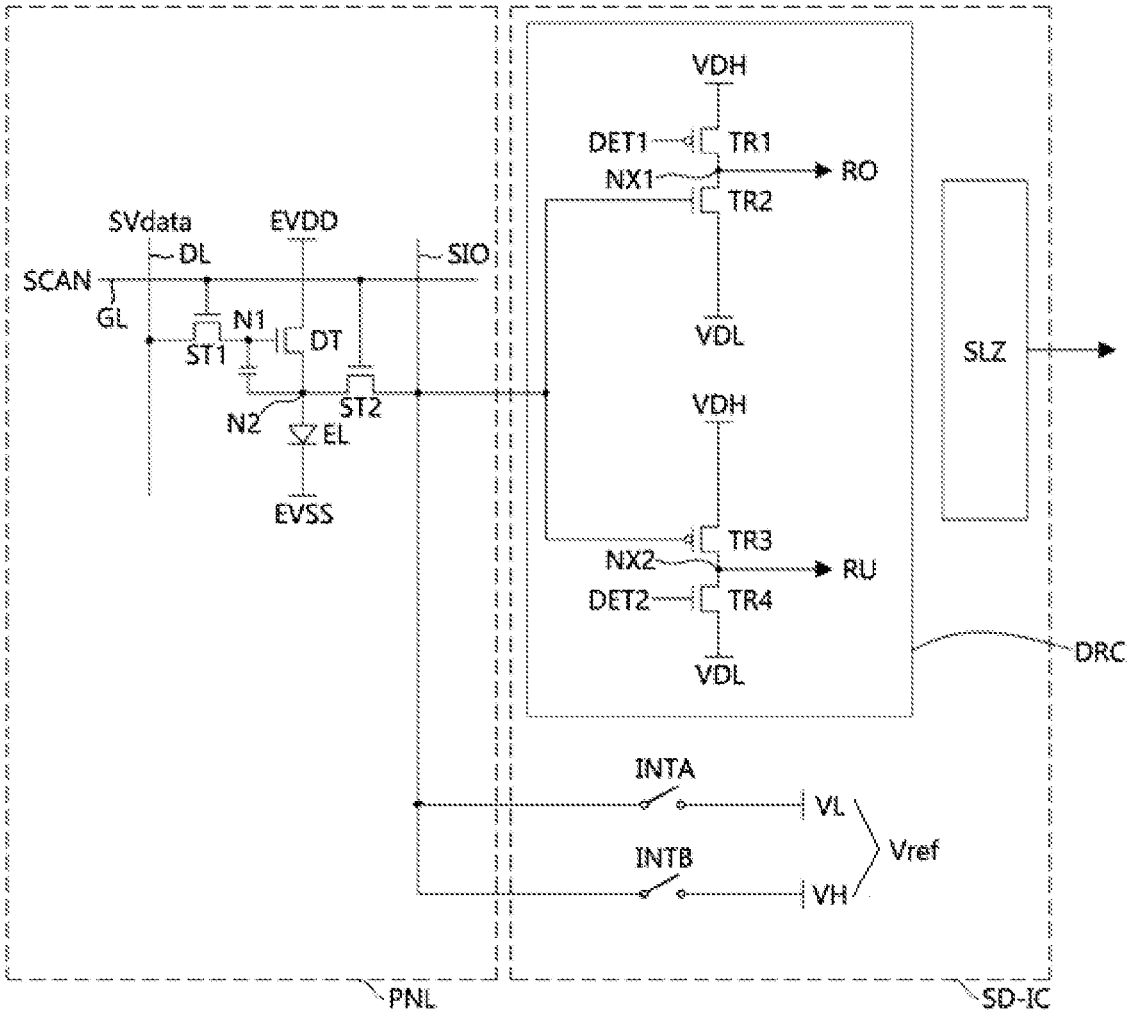
FIG. 25 is a diagram illustrating a detailed connection configuration between a pixel and a dynamic logic circuit included in the detect processing circuit of FIG. 24.
Figure 26:
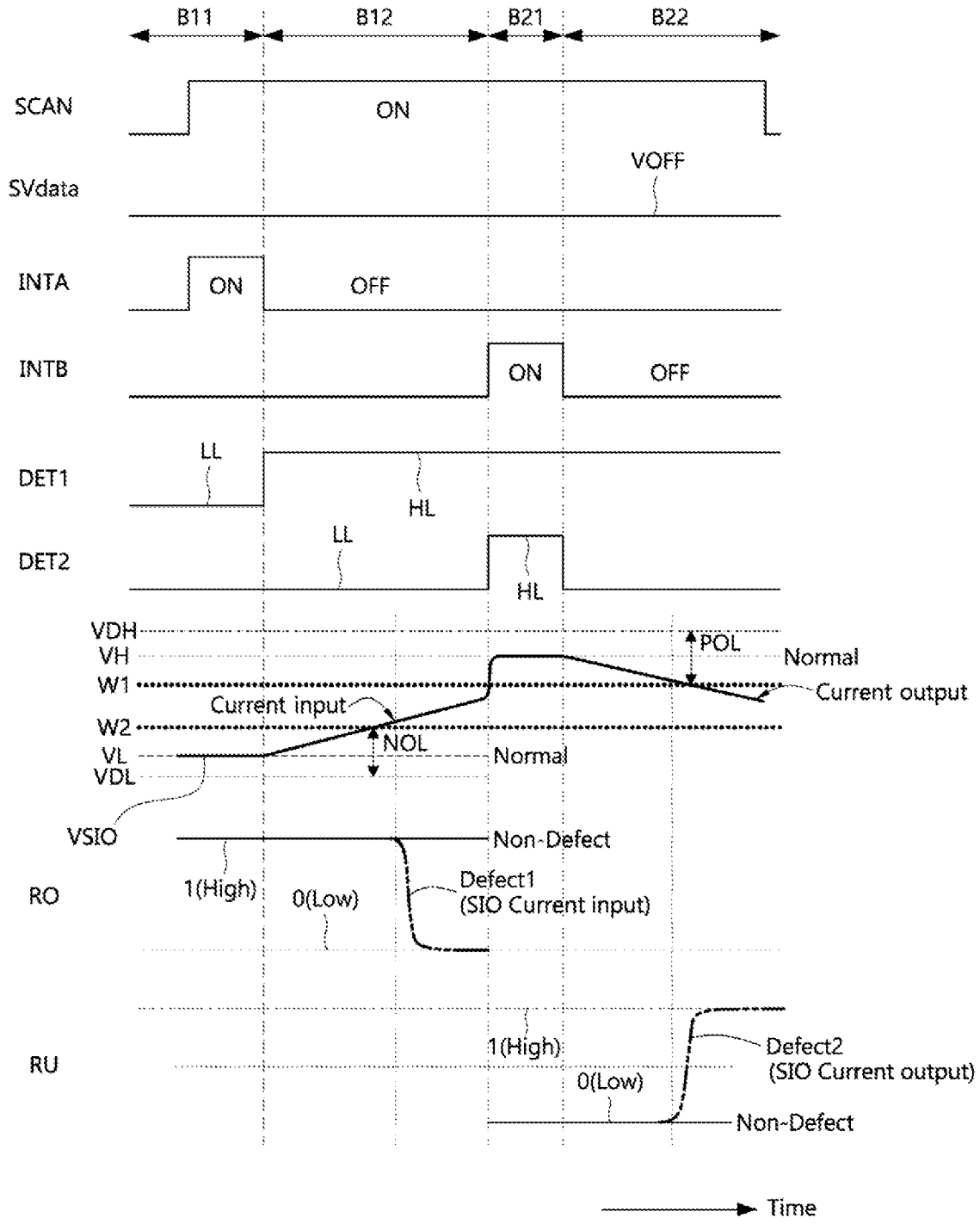
FIG. 26 is a diagram showing a driving waveform of the pixel and the detect processing circuit of FIG. 25.

Next, FIG. 25 is a diagram illustrating a detailed connection configuration between a pixel and a dynamic logic circuit included in the detect processing circuit of FIG. 24. In addition, FIG. 26 is a diagram showing a driving waveform of the pixel and the detect processing circuit of FIG. 25, and FIG. 27 is a diagram showing an output of a dynamic logic circuit performed in a first initialization interval and a first detection interval of FIG. 26. Also, FIG. 28 is a diagram showing an output of a dynamic logic circuit performed in a second initialization interval and a second detection interval of FIG. 26.

Referring to FIGS. 25 to 28, the dynamic logic circuit DRC includes first and second transistors TR1 and TR2 for generating a first logic output DO through a first output node NX1 and third and fourth transistors TR3 and TR4 for generating a second logic output DU through a second output node NX2. The first and second transistors TR1 and TR2 are connected serially between a high level power VDH and a low level power VDL. Also, the first transistor TR1 is connected between the high level power VDH and the first output node NX1 and is turned on based on the first switching control signal DET1. Further, the second transistor TR2 is connected between the first output node NX1 and the low level power VDL and is turned on based on a voltage VSIO of a detection line. Also, the first transistor TR1 can be a P-type transistor, and the second transistor TR2 can be an N-type transistor.

The third and fourth transistors TR3 and TR4 are connected serially between the high level power VDH and the low level power VDL. In addition, the third transistor TR3 is connected between the high level power VDH and the second output node NX2 and is turned on based on the voltage VSIO of the detection line. The fourth transistor TR4 is also connected between the second output node NX2 and the low level power VDL and is turned on based on the second switching control signal DET2. Further, the third transistor TR3 can be a P-type transistor, and the fourth transistor TR4 can be an N-type transistor.

In addition, the panel driving circuit supplies the pixel PXL with a scan signal SCAN having an on level and a detection data voltage SVdata having an off level VOFF in a first initialization interval B11, a first detection interval B12, a second initialization interval B21, and a second detection interval B21 to off-drive driving elements included in the pixel PXL. A first initialization switch INTA is turned on in the first initialization interval B11, and in the other interval, is turned off. A second initialization switch INTB is turned on in the second initialization interval B21, and in the other interval, is turned off. Further, a first detection reference voltage VL supplied to the detection line SIO in the first initialization interval B11 is higher than the low level power VDL and lower than a voltage W2 for sufficiently turning on an N-type transistor (i.e., the second transistor TR2). A second detection reference voltage VH supplied to the detection line SIO in the second initialization interval B21 is higher than the low level power VDL. Also, the second detection reference voltage VH is lower than the high level power VDH and is higher than a voltage W1 for sufficiently turning on a P-type transistor (i.e., the third transistor TR3).

In addition, the first switching control signal DET1 can maintain a low voltage level LL in the first initialization interval B11, and in other intervals, can maintain a high voltage level HL. The low voltage level LL of the first switching control signal DET1 can be a voltage for sufficiently turning on a P-type transistor (i.e., the first transistor TR1), and the high voltage level HL of the first switching control signal DET1 can be a voltage for sufficiently turning off a P-type transistor. Accordingly, the first transistor TR1 can maintain an on state based on the first switching control signal DET1 having the low voltage level LL in the first initialization interval B11 and can maintain an off state based on the first switching control signal DET1 having the high voltage level HL in the first detection interval B12.

Also, the second switching control signal DET2 can maintain the high voltage level HL in the second initialization interval B21, and in other intervals, can maintain the low voltage level LL. The high voltage level HL of the second switching control signal DET2 can be a voltage for sufficiently turning on an N-type transistor (i.e., the fourth transistor TR4), and the low voltage level LL of the second switching control signal DET2 can be a voltage for sufficiently turning off an N-type transistor. Accordingly, the fourth transistor TR4 can maintain an on state based on the second switching control signal DET2 having the high voltage level HL in the second initialization interval B21 and can maintain an off state based on the second switching control signal DET2 having the low voltage level LL in the second detection interval B22.

In the first initialization interval B11, in response to the first switching control signal DET1, the dynamic logic circuit DRC can charge a high output '1' based on the high level power VDH into the first output node NX1. In the second initialization interval B21, in response to the second switching control signal DET2, the dynamic logic circuit DRC can charge a low output '0' based on the low level power VDL into the second output node NX2.

When the voltage VSIO of the detection line is higher than a threshold voltage W2 or NOL of an N-type transistor in the first detection interval B12, the second transistor TR2 is turned on, and thus the first output node NX1 is connected to the low level power VDL and a first logic output RO can be shifted from the high output '1' of the first initialization interval B11 to the low output '0' based on the low level power VDL. Because the first logic output RO is shifted to the low output '0' in the first detection interval B12, a logic circuit BPCL (see FIG. 24) can determine a defect where the pixel PXL has the defect 1 of the overflow type.

On the other hand, when the voltage VSIO of the detection line is lower than the threshold voltage W2 or NOL of the N-type transistor in the first detection interval B12, the second transistor TR2 can be turned off, and thus, the first output node NX1 can be floated and the first logic output RO can be maintained to be the high output '1' of the first initialization interval B11. Because the first logic output RO maintains the high output '1' in the first detection interval B12, the logic circuit BPCL (see FIG. 24) can determine that the pixel PXL is normal.

When the voltage VSIO of the detection line is lower than a threshold voltage W1 or POL of a P-type transistor in the second detection interval B22, the third transistor TR3 can be turned on, and thus the second output node NX2 can be connected to the high level power VDH and a second logic output RU can be shifted from the low output '0' of the second initialization interval B21 to the high output '1' based on the high level power VDH. Because the second logic output RU is shifted to the high output '1' in the second detection interval B22, the logic circuit BPCL (see FIG. 24) can determine a defect where the pixel PXL has the defect 2 of the underflow type.

On the other hand, when the voltage VSIO of the detection line is higher than the threshold voltage W1 or POL of the P-type transistor in the second detection interval B22, the third transistor TR3 can be turned off, and thus the second output node NX2 can be floated and the second logic output RU can be maintained to be the low output '0' of the second initialization interval B21. Because the second logic output RU maintains the low output '0' in the second detection interval B22, the logic circuit BPCL (see FIG. 24) can determine that the pixel PXL is normal.

The present embodiment provides the following advantages. In the present embodiment, two comparison outputs based on each pixel are generated by using a comparator included in a source driving IC or a control PCB. In addition, the occurrence of a defect in a corresponding pixel can be determined based on a logic combination of the two comparison outputs.

Further, two logic outputs based on each pixel can be generated by using a dynamic logic circuit included in a source driving IC. In addition, the occurrence of a defect in a corresponding pixel can be determined based on a logic combination of the two logic outputs or each of the two logic outputs.

Therefore, in the present embodiment, the display quality increases by detecting and compensating for a hot spot defect caused by subpixel short circuit. Further, a circuit unit for detecting and compensating for a hot spot defect caused by subpixel short circuit can be minimized, thereby reducing the manufacturing cost and increasing the lifetime and reliability of products.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. An electroluminescent display apparatus comprising:

a pixel connected to a detection line;

a panel driving circuit configured to off-drive a driving element included in the pixel in a detection interval;

a reference voltage generating circuit configured to supply a detection reference voltage to the detection line prior to the detection interval, generate a first comparator reference voltage which is higher than the detection reference voltage in the detection interval, and generate a second comparator reference voltage which is lower than the detection reference voltage in the detection interval;

a comparator configured to compare the first comparator reference voltage with a voltage of the detection line to generate a first comparison output at a first timing of the detection interval and to compare the second comparator reference voltage with the voltage of the detection line to generate a second comparison output at a second timing of the detection interval; and a logic circuit configured to determine an occurrence of a defect of the pixel based on the first comparison output and the second comparison output and to perform dark spot processing of the defective pixel.

2. The electroluminescent display apparatus of claim 1, wherein the logic circuit is further configured to determine the occurrence of the defect of the pixel based on a logic combination of the first comparison output and the second comparison output.

3. The electroluminescent display apparatus of claim 1, wherein the comparator, the logic circuit, and the reference voltage generating circuit are mounted on a control printed circuit board, and wherein a number of comparators is less than a number of detection lines.

4. The electroluminescent display apparatus of claim 3, wherein the comparator comprises a first input terminal inputting the first comparator reference voltage and the second comparator reference voltage, a second input terminal inputting the voltage of the detection line, and an output terminal outputting the first comparison output and the second comparison output, wherein the electroluminescent display apparatus further comprises an enable switch connected between the second input terminal and the output terminal of the comparator, wherein the logic circuit is further configured to turn off the enable switch in the detection interval, and turn on the enable switch in an initialization interval preceding the detection interval, and wherein the reference voltage generating circuit is further configured to supply the detection reference voltage to the detection line through the comparator in the initialization interval.

5. The electroluminescent display apparatus of claim 3, further comprising:

a plurality of source driving integrated circuits with multiplexer switches and a portion of the panel driving circuit mounted thereon, wherein the comparator is connected to a plurality of detection lines through the multiplexer switches, and wherein the logic circuit detects the occurrence of the defect of the pixel by one horizontal display line units including a plurality of pixels based on a turn-on or off of the multiplexer switches, detects by one source driving integrated circuit units subsequently thereto, and detects by one detection line units subsequently thereto.

6. The electroluminescent display apparatus of claim 1, further comprising:

a plurality of source driving integrated circuits with a portion of the panel driving circuit mounted thereon, wherein the comparator includes a plurality of comparators mounted on each of the plurality of source driving integrated circuits, wherein the logic circuit and the reference voltage generating circuit are mounted on a control printed circuit board, and wherein a number of comparators is equal to a number of detection lines.

7. The electroluminescent display apparatus of claim 6, wherein the comparator comprises a first input terminal inputting the first comparator reference voltage and the second comparator reference voltage, a second input terminal inputting the voltage of the detection line, and an output terminal outputting the first comparison output and the second comparison output, wherein the electroluminescent display apparatus further comprises an initialization switch connected between the first input terminal and the second input terminal of the comparator, wherein the logic circuit turns off the initialization switch in the detection interval, and turns on the initialization switch on in an initialization interval preceding the detection interval, and wherein the reference voltage generating circuit is further configured to supply the detection reference voltage to the detection line through the comparator in the initialization interval.

8. The electroluminescent display apparatus of claim 6, wherein each of the plurality of source driving integrated circuits further comprises a serialization circuit, and wherein the serialization circuit is configured to serialize the first comparison output and the second comparison output input from each of the plurality of comparators to supply serial transfer data to the logic circuit.

9. The electroluminescent display apparatus of claim 1, wherein the pixel comprises a plurality of subpixels sharing the detection line, and when one of the plurality of subpixels is determined to be defective, the logic circuit is further configured to perform dark spot processing on only a defective subpixel or perform dark spot processing on an entire pixel including the defective subpixel.

10. An electroluminescent display apparatus comprising:

a pixel;

a panel driving circuit configured to supply the pixel with a scan signal having an on level and a detection data voltage having an off level in a detection interval;

a comparator including a first input terminal receiving a reference voltage and a second input terminal connected with the detection line; and a logic circuit configured to determine an occurrence of a defect of the pixel based on a first comparison output and a second comparison output of the comparator at a first and second timings of the detection interval, respectively, and to perform dark spot processing of the defective pixel, wherein the reference voltage is set as a first comparator reference voltage higher than a detection reference voltage in the first timing, and as a second comparator reference voltage lower than the detection reference voltage in the second timing, and wherein the detection reference voltage is the same as a voltage supplied to the detection line prior to the detection interval.

11. An electroluminescent display apparatus comprising:

a pixel connected to a detection line;

a panel driving circuit configured to off-drive a driving element included in the pixel in a detection interval;

a reference voltage generating circuit configured to supply a detection reference voltage to the detection line in an initialization interval preceding the detection interval;

a dynamic logic circuit including a first output node and a second output node connected between a first level power and a second level power, the dynamic logic circuit being configured to generate a first logic output through a first output node and generate a second logic output through a second output node, and the first logic output and the second logic output being shifted based on a voltage of the detection line shifted from the detection reference voltage in the detection interval; and a logic circuit configured to determine an occurrence of a defect in a pixel based on the first logic output and the second logic output, and to perform dark spot processing of the defective pixel.

12. The electroluminescent display apparatus of claim 11, wherein the logic circuit determines the occurrence of the defect in the pixel, based on a logic combination of the first logic output and the second logic output obtained in the detection interval, and wherein, in a pre-charge interval between the initialization interval and the detection interval, the dynamic logic circuit pre-charges a first output based on the first level power into the first output node and pre-charges a second output based on the second level power into the second output node.

13. The electroluminescent display apparatus of claim 12, wherein, when the voltage of the detection line is higher than a threshold voltage of an N-type transistor in the detection interval, the first output node is connected to the second level power and the first logic output is shifted from the pre-charged first output to the second output, and the second output node is floated and the second logic output is maintained as the pre-charged second output.

14. The electroluminescent display apparatus of claim 12, wherein, when the voltage of the detection line is lower than a threshold voltage of a P-type transistor in the detection interval, the first output node is floated and the first logic output is maintained as the pre-charged first output, and the second output node is connected to the first level power and the second logic output is shifted from the pre-charged second output to the first output.

15. The electroluminescent display apparatus of claim 12, wherein, when the voltage of the detection line is higher than a threshold voltage of a P-type transistor and is lower than a threshold voltage of an N-type transistor in the detection interval, the first output node is floated and the first logic output is maintained as the pre-charged first output, and the second output node is floated and the second logic output is maintained as the pre-charged second output.

16. The electroluminescent display apparatus of claim 12, wherein the dynamic logic circuit comprises:

a first transistor connected between the first level power and the first output node and turned on based on a first switching control signal;

a second transistor connected between the first output node and a first connection node and turned on based on the voltage of the detection line;

a third transistor connected between the first connection node and the second level power and turned on based on the first switching control signal;

a fourth transistor connected between the first level power and a second connection node and turned on based on a second switching control signal;

a fifth transistor connected between the second output node and a second connection node and turned on based on the voltage of the detection line; and a sixth transistor connected between the second output node and the second level power and turned on based on the second switching control signal, wherein each of the first transistor, the fourth transistor, and the fifth transistor is a P-type transistor, and wherein each of the second transistor, the third transistor, and the sixth transistor is an N-type transistor.

17. The electroluminescent display apparatus of claim 16, wherein the first switching control signal and the second switching control signal have opposite phases.

18. The electroluminescent display apparatus of claim 16, wherein, in the pre-charge interval, the first switching control signal maintains a second voltage level which is lower than a threshold voltage of a P-type transistor, and the second switching control signal maintains a first voltage level which is higher than a threshold voltage of an N-type transistor, and wherein in the detection interval, the first switching control signal maintains the first voltage level, and the second switching control signal maintains the second voltage level.

19. The electroluminescent display apparatus of claim 11, further comprising a plurality of source driving integrated circuits with a portion of the panel driving circuit mounted thereon, wherein the dynamic logic circuit is mounted on each of the plurality of source driving integrated circuits.

20. An electroluminescent display apparatus comprising:

a pixel connected to a detection line;

a panel driving circuit configured to off-drive a driving element included in the pixel in a first detection interval and a second detection interval;

a reference voltage generating circuit configured to supply a first detection reference voltage to the detection line in a first initialization interval preceding the first detection interval and supply a second detection reference voltage to the detection line in a second initialization interval preceding the second detection interval;

a dynamic logic circuit including a first output node and a second output node connected between a first level power and a second level power, the dynamic logic circuit being configured to generate a first logic output through the first output node and generate a second logic output through the second output node, the first logic output being shifted based on a voltage of the detection line in the first detection interval, and the second logic output being shifted based on a voltage of the detection line in the second detection interval; and a logic circuit configured to determine an occurrence of a defect in the pixel based on one of the first logic output obtained in the first detection interval and the second logic output, and to perform dark spot processing of the defective pixel.

* * * * *